US009151109B2

(12) United States Patent
Kawai et al.

(10) Patent No.: US 9,151,109 B2
(45) Date of Patent: Oct. 6, 2015

(54) OPERATION APPARATUS OF SUNLIGHT SHIELDING APPARATUS, LIFTING APPARATUS OF ROLL-UP BLIND AND OPERATION PULLEY

(75) Inventors: Eiji Kawai, Tokyo (JP); Hajime Nakamura, Tokyo (JP); Yoshiyuki Hadano, Tokyo (JP); Tadashi Okamura, Tokyo (JP)

(73) Assignee: Tachikawa Corporation, Tokyo (JP)

( * ) Notice: Subject to any disclaimer, the term of this patent is extended or adjusted under 35 U.S.C. 154(b) by 440 days.

(21) Appl. No.: 13/641,060

(22) PCT Filed: Apr. 12, 2011

(86) PCT No.: PCT/JP2011/059113
§ 371 (c)(1),
(2), (4) Date: Oct. 12, 2012

(87) PCT Pub. No.: WO2011/129345
PCT Pub. Date: Oct. 20, 2011

(65) Prior Publication Data

US 2013/0056164 A1 Mar. 7, 2013

(30) Foreign Application Priority Data

Apr. 12, 2010 (JP) ..... 2010-091737
Oct. 29, 2010 (JP) ..... 2010-244700
Jan. 21, 2011 (JP) ..... 2011-011426

(51) Int. Cl.
*E06B 9/56* (2006.01)
*E06B 9/322* (2006.01)
(Continued)

(52) U.S. Cl.
CPC ..... *E06B 9/322* (2013.01); *E06B 9/262* (2013.01); *E06B 9/303* (2013.01); *E06B 9/304* (2013.01);
(Continued)

(58) Field of Classification Search
CPC ..... E06B 9/326; E06B 9/322; E06B 9/64; E06B 9/78; E06B 2009/42
USPC ..... 160/168.1 R, 321, 309, 319, 313, 173 R
See application file for complete search history.

(56) References Cited

U.S. PATENT DOCUMENTS 4,487,245 A * 12/1984 Shinohara et al. ..... 160/313
4,519,487 A * 5/1985 Florin ..... 192/36
(Continued)

FOREIGN PATENT DOCUMENTS

DE 202006004867 U1 7/2006
EP 0761118 A2 3/1997
(Continued)

OTHER PUBLICATIONS

Office Action issued in corresponding Chinese application No. 201180018706.5, dated Apr. 30, 2014.
(Continued)

*Primary Examiner* — Katherine Mitchell
*Assistant Examiner* — Johnnie A Shablack
(74) *Attorney, Agent, or Firm* — Maier & Maier, PLLC

(57) ABSTRACT

An operation apparatus of a sunlight shielding apparatus is provided which is equipped with a fail-safe function so as not to hinder behavior of a dweller or the like, and, in usual operation, unnecessary activation of the fail-safe function is prevented, so that enhanced operability can be realized. In a sunlight shielding apparatus in which an operation cord of an endless type is suspended from a pulley supported so as to be capable of rotating in a head box, and a driving shaft is rotated based on an operation of the operation cord by way of the pulley so as to drive a shielding member, the operation cord 16 is made into an endless type by coupling via a coupling section which is configured to be decoupled with a predetermined first pull force, and a torque limiter 18 is interposed between the pulley 15 and the driving shaft 11, 12, the torque limiter being configured to run idle with a second rotation torque which is smaller than a first rotation torque which is exerted on the pulley by the first pull force.

7 Claims, 25 Drawing Sheets

(51) Int. Cl.

| | |
|---|---|
| ***E06B 9/262*** | (2006.01) |
| ***E06B 9/303*** | (2006.01) |
| ***E06B 9/304*** | (2006.01) |
| ***E06B 9/326*** | (2006.01) |
| ***E06B 9/66*** | (2006.01) |
| ***E06B 9/42*** | (2006.01) |
| ***E06B 9/64*** | (2006.01) |
| *E06B 9/24* | (2006.01) |

(52) U.S. Cl.

CPC . *E06B 9/326* (2013.01); *E06B 9/42* (2013.01); *E06B 9/64* (2013.01); *E06B 9/66* (2013.01); *E06B 2009/2441* (2013.01); *E06B 2009/2447* (2013.01); *E06B 2009/2625* (2013.01); *E06B 2009/3265* (2013.01)

(56) References Cited

U.S. PATENT DOCUMENTS

| | | | | | |
|---|---|---|---|---|---|
| 4,534,396 | A * | 8/1985 | Jung | 160/298 |
| 5,167,269 | A * | 12/1992 | Abo | 160/305 |
| 5,361,822 | A * | 11/1994 | Nijs | 160/321 |
| 5,411,445 | A * | 5/1995 | Oda | 474/154 |
| 5,443,109 | A * | 8/1995 | Benthin | 160/298 |
| 5,566,741 | A * | 10/1996 | Ogawara et al. | 160/297 |
| 5,634,244 | A * | 6/1997 | Fetsch et al. | 24/115 F |
| 5,669,432 | A * | 9/1997 | Nisenson et al. | 160/307 |
| 5,983,972 | A * | 11/1999 | Chou | 160/319 |
| 6,116,325 | A | 9/2000 | Colson et al. | |
| 6,123,140 | A * | 9/2000 | Bergamaschi | 160/316 |
| 6,138,740 | A * | 10/2000 | Chou | 160/319 |
| 6,158,563 | A * | 12/2000 | Welfonder et al. | 192/223.3 |
| 6,164,428 | A * | 12/2000 | Berman et al. | 192/223.4 |
| 6,237,669 | B1 * | 5/2001 | Ko | 160/177 V |
| 6,250,359 | B1 * | 6/2001 | Lorio et al. | 160/178.1 V |
| 6,381,903 | B1 * | 5/2002 | Desrochers et al. | 49/139 |
| 6,429,609 | B1 * | 8/2002 | Hugin | 318/17 |
| 6,685,592 | B2 * | 2/2004 | Fraczek et al. | 475/14 |
| 6,739,373 | B1 * | 5/2004 | Liu et al. | 160/321 |
| 6,845,803 | B1 | 1/2005 | Nien | |
| 6,860,312 | B2 * | 3/2005 | Judkins | 160/243 |
| 7,665,505 | B2 * | 2/2010 | McCormick et al. | 160/238 |
| 8,025,088 | B2 * | 9/2011 | Kim | 160/120 |
| 8,136,569 | B2 * | 3/2012 | Bohlen et al. | 160/323.1 |
| 8,336,598 | B1 * | 12/2012 | Chang | 160/321 |
| 8,893,766 | B2 * | 11/2014 | Bohlen | 160/323.1 |
| 8,898,871 | B2 * | 12/2014 | Nakamura et al. | 24/663 |
| 2003/0085003 | A1 * | 5/2003 | Cheng | 160/321 |
| 2003/0154742 | A1 * | 8/2003 | Ooide | 63/38 |
| 2004/0163774 | A1 * | 8/2004 | Nien et al. | 160/168.1 OP |
| 2005/0022948 | A1 | 2/2005 | Nien | |
| 2005/0087312 | A1 * | 4/2005 | Nien | 160/178.1 R |
| 2007/0119552 | A1 * | 5/2007 | Wang et al. | 160/321 |
| 2007/0125501 | A1 * | 6/2007 | Liang | 160/84.01 |
| 2007/0246173 | A1 * | 10/2007 | Liu | 160/309 |
| 2008/0190572 | A1 * | 8/2008 | Kwak | 160/313 |
| 2008/0219604 | A1 * | 9/2008 | Chen et al. | 384/43 |
| 2008/0251624 | A1 * | 10/2008 | Fraczek et al. | 242/389 |
| 2010/0186907 | A1 * | 7/2010 | Kraler et al. | 160/176.1 P |
| 2010/0212843 | A1 * | 8/2010 | Bohlen et al. | 160/168.1 R |
| 2010/0276530 | A1 * | 11/2010 | Di Stefano | 242/370 |
| 2011/0108215 | A1 * | 5/2011 | Levin | 160/308 |
| 2011/0108216 | A1 * | 5/2011 | Levin | 160/340 |
| 2011/0194895 | A1 * | 8/2011 | Lai | 403/361 |
| 2012/0216968 | A1 * | 8/2012 | Nakamura | 160/340 |
| 2013/0056162 | A1 * | 3/2013 | Aoki | 160/87 |
| 2013/0056164 | A1 * | 3/2013 | Kawai et al. | 160/321 |
| 2013/0264018 | A1 * | 10/2013 | Chou | 160/319 |
| 2014/0014280 | A1 * | 1/2014 | Bohlen | 160/291 |
| 2014/0041815 | A1 * | 2/2014 | Kao | 160/319 |
| 2014/0130989 | A1 * | 5/2014 | Chan et al. | 160/309 |
| 2014/0290871 | A1 * | 10/2014 | Muto | 160/84.01 |
| 2014/0338847 | A1 * | 11/2014 | Kao | 160/319 |

FOREIGN PATENT DOCUMENTS

| | | | |
|---|---|---|---|
| JP | 63-010198 | U | 1/1988 |
| JP | 03-005680 | Y2 | 2/1991 |
| JP | 2001-207754 | A | 8/2001 |
| JP | 2003-184456 | A | 7/2003 |
| JP | 2006-283320 | A | 10/2006 |
| JP | 2007-177440 | A | 7/2007 |
| JP | 2009-002121 | A | 1/2009 |

OTHER PUBLICATIONS

International Search Report dated May 11, 2011, as issued in International Application No. PCT/JP2011/059113; filed Apr. 12, 2011 and English translation, 4 pages.

* cited by examiner

OPERATION APPARATUS OF SUNLIGHT SHIELDING APPARATUS, LIFTING APPARATUS OF ROLL-UP BLIND AND OPERATION PULLEY

RELATED APPLICATIONS

This application is the national stage of international patent application No.: PCT/JP2011/059113, filed on Apr. 12, 2011, which claims priority to Japanese Patent Application Nos. 2010-091737, filed Apr. 12, 2010, 2010-244700, filed Oct. 29, 2010, and 2011-011426, filed Jan. 21, 2011, the disclosures of which are incorporated by reference herein their entireties.

TECHNICAL FIELD

This invention relates to an operation apparatus and a lifting apparatus which have a fail-safe function and, more specifically, to (1) an operation apparatus of a sunlight shielding apparatus in which an endless operation cord suspended from a pulley is operated to perform an lifting operation or transferring operation of a sunlight shielding member, (2) an operation apparatus of a sunlight shielding apparatus which supports a head box between opposed wall surfaces, and (3) a lifting apparatus of a roll-up blind in which a bottom end of a screen is wound up around a weight bar and wound off by a lifting cord to allow the screen to move up and down.

BACKGROUND ART (1) About an operation apparatus equipped with a fail-safe function As a kind of an operation apparatus of a horizontal blind, one is known in which an operation cord is suspended from a pulley supported by a head box so as to be capable of rotating, and raising or lowering operation and angle-adjusting operation of slats are performed through operations of the operation cord.

In such a horizontal blind, the pulley is supported on a front surface of one side of the head box so as to be capable of rotating and the pulley is covered with a pulley case. When the operation cord suspended from the pulley is operated, the pulley is rotated and a driving shaft is rotated based on a rotation of the pulley by way of a gear box within the head box.

When the driving shaft is rotated, a bottom rail is raised or lowered by way of a lifting cord so as to raise or lower the slats. Also, the slats are rotated by way of a ladder cord.

In the above-mentioned horizontal blind, the endless operation cord is sometimes caught on a dweller or a household item, so that their behavior is unduly restricted. Therefore, an operation apparatus is proposed in which, when the operation cord is pulled with a greater force than an operation force applied in usual operations, the pulley is caused to drop off from the head box, so that the movement of the dweller is not hindered.

Patent document 1 discloses an operation apparatus which is equipped with a fail-safe function where, when an excessive downward pull force is applied to the operation cord, the pulley and the pulley case are caused to fall, so that hindrance of behavior of a dweller due to an accidental catch of the operation cord is prevented.

(2) About a case in which a horizontal blind is arranged in a bath room.

Conventionally, when a horizontal blind is arranged in a bath room, since it is not possible to fix an attaching bracket for supporting a head box on a wall surface by means of a screw, a fixing apparatus that fixes the head box between opposed wall surfaces has been in practical use.

Patent document 2 discloses a fixing apparatus where a moving shaft is provided to an end portion of a head box so as to be capable of protruding and receding, a protrusion length of the moving shaft from the end of the head box is adjusted by a rotational operation of a dial, so that the head box is provisionally held between wall surfaces, and subsequently, the moving shaft is forcibly pressed against the wall surface by a rotational operation of an operation lever so as to fix the head box between the wall surfaces.

In such a horizontal blind, raising or lowering operation and angle-adjusting operation of slats are performed by operating a ball-chain (operation cord) suspended from an end of the head box supported between the wall surfaces.

(3) About a roll-up blind

In a roll-up blind, a top end of a screen is attached to a head box, and a bottom end of the screen is attached to a weight bar of a round bar shape. A lifting cord for raising and lowering the screen is attached, at one end thereof, to a back surface of the head box, and, at another end thereof, to a winding shaft within the head box so as to be capable of being wound up, via a position below the weight bar. The weight bar is supported by the lifting cord which is wound around a lower part thereof.

When the winding shaft is rotated by an operation apparatus, the lifting cord is wound up around the winding shaft, so that the weight bar moves up while winding up the screen. When the winding shaft is rotated to wind off the lifting cord from the winding shaft, the weight bar moves down while winding off the screen.

Patent document 3 discloses a roll-up blind where a chip-blind is used as a screen.

PRIOR ART DOCUMENT

Patent Document

Patent document 1: U.S. Pat. No. 6,116,325
Patent document 2: JP 2001-207754A
Patent document 3: JP 2006-283320A
Patent document 4: U.S. Pat. No. 6,845,803

SUMMARY OF THE INVENTION

Problems to be Resolved by the Invention (1) About an operation apparatus equipped with a fail-safe function With the operation apparatus disclosed in Patent document 1, if a load to the driving shaft increases, even in the usual use, so that the pull force applied to the operation cord increases, a possibility arises that the pulley and the pulley case drop off.

When the pulley and the pulley case drop off, it is necessary to set the operation cord on the pulley again and attach the pulley and the pulley case to the head box, which is a cumbersome work.

Therefore, an object according to a first aspect of the present invention is to provide an operation apparatus of a sunlight shielding apparatus which is equipped with a fail-safe function so as not to hinder behavior of a dweller or the like, and, in a usual operation, unnecessary activation of the fail-safe function is prevented so that enhanced operability can be realized.

(2) About a case in which a horizontal blind is arranged in a bath room

With the above-mentioned horizontal blind, when in a state where the slats are raised to an upper limit thereof, the ball chain is further operated in a direction for raising the slats, an excessively great pull force is applied to the ball chain. As a result, a problem arises that the head box falls down or a slat operation apparatus in the head box is broken.

An object according to a second aspect of the present invention is to provide an operation apparatus of a sunlight shielding apparatus where falling of the head box or breakage of the operation apparatus due to an operation of the operation cord can be prevented.

(3) About a Roll-Up Blind

With the above-mentioned roll-up blind, the lifting cord suspended from the head box and wound around the weight bar is sometimes caught on a dweller moving in the room or another moving object, so that the movement thereof is interfered.

Patent document 4 discloses a blind whose lifting cord is attached to the head box by way of a joint apparatus. The joint apparatus is so configured that a connection state of the lifting cord and the head box is canceled when an excessively great pull force is applied to the lifting cord.

However, there is a problem that if an excessively great force is applied to the lifting cord in a raising operation of the blind, the joint apparatus is sometimes divided, so that the bottom rail falls down.

An object according to a third aspect of the present invention is to provide a lifting apparatus of a roll-up blind which does not hinder a movement of a dweller or the like due to an accidental catch of the lifting cord, and which can prevent the lifting cord from splitting in the raising operation of the screen.

That is, the present invention provides an operation cord or a lifting cord where even if an excessive pull force is applied, hindrance of movement of a dweller or the like as well as breakage of the operation apparatus or the lifting apparatus can be prevented.

Means for Solving the Problems

The problems noted above can be solved by any one of the first to fourth aspects of the present invention. The contents described below with respect to the first to fourth aspects can be combined with one another, and excellent effects are obtained by combining them. The object and the effect of the first aspect can be achieved by the contents of the first aspect, the object and the effect of the second aspect can be achieved by the contents of the second aspect, and the object and the effect of the third aspect can be achieved by the contents of the third aspect. The fourth aspect is related to an operation pulley which can be used in the first to third aspects.

According to the first aspect of the present invention, an operation apparatus of a sunlight shielding apparatus is provided in which an operation cord of an endless type is suspended from a pulley supported so as to be capable of rotating in a head box, and a driving shaft is rotated based on an operation of the operation cord by way of the pulley so as to drive a shielding member, wherein the operation cord is made into an endless type by coupling via a coupling section which is configured to be decoupled with a predetermined first pull force, and a torque limiter is interposed between the pulley and the driving shaft, the torque limiter being configured to run idle with a second rotation torque which is smaller than a first rotation torque which is exerted on the pulley by the first pull force.

Preferably, the torque limiter comprise a transmission shaft configured to transmit a rotation torque of the pulley to the driving shaft; and biasing means interposed between the pulley and the transmission shaft and configured to transmit the rotation torque of the pulley to the transmission shaft based on a friction force, wherein the biasing means is configured to run idle relative to the transmission shaft with the second rotation torque.

Preferably, torque ripple generation means is disposed between the biasing means and the transmission shaft, the torque ripple generation means being configured to generate a torque ripple when it runs idle relative to the transmission shaft.

Preferably, a clutch apparatus is disposed between the transmission shaft and the driving shaft, the clutch apparatus being configured to select a rotation direction of the driving shaft.

Preferably, the biasing means is formed of a helical torsion spring.

According to the second aspect of the present invention, an operation apparatus of a sunlight shielding apparatus is provided in which a head box is provided, at both ends thereof, with fixing apparatuses having shafts protruding toward wall surfaces opposed to each other, the head box is fixed between the wall surfaces with a pushing force of the shafts, an endless-type operation cord is suspended from an operation unit (operation apparatus) disposed in the head box, and a sunlight shielding member supported by the head box is driven by an operation of the operation cord, wherein the operation unit is provided with a torque limiter which limits a sum of a pull force exerted on the head box based on the operation of the operation cord and a weight of the sunlight shielding apparatus exerted on the head box to a range not exceeding a retention force due to the pushing force of the fixing apparatus.

Preferably, the operation cord is formed into an endless type by way of a coupling section and provided, at the coupling section, with coupling cancellation means which cancels a coupling with a smaller pull force than a pull force causing the head box to fall.

Preferably, the torque limiter comprises a pulley configured to be rotated based on the operation of the operation cord; a driving gear configured to be rotated based on a rotation of the pulley; and torque absorbing means interposed between the pulley and the driving gear and configured to limit a rotation torque exerted on the pulley.

Preferably, the torque absorbing means is provided with a cam member configured to rotate integrally with the pulley; a concave/convex portions provided to the cam member and the driving gear, respectively, and configured to engage with each other; and biasing means configured to hold an engagement of the concave/convex portions elastically.

Preferably, a sunlight shielding apparatus is configured such that a head box is provided, at both ends thereof, with fixing apparatuses having shafts protruding toward wall surfaces opposed to each other, the head box is fixed between the wall surfaces with a pushing force of the shafts, an operation cored is suspended from an operation unit disposed in the head box, the operation cord being formed into an endless type by means of a coupling section, and a sunlight shielding member supported by the head box is driven by an operation of the operation cord, wherein the coupling section is provided with coupling cancellation means which limits a sum of a pull force exerted on the head box based on the operation of the operation cord and a weight of the sunlight shielding apparatus exerted on the head box to a range not exceeding the pushing force of the fixing apparatuses.

Preferably, the fixing apparatuses are provided with biasing means configured to provide the shafts with a constant biasing force as the pushing force; and a cam mechanism configured to switch between a state in which the biasing force is supplied to the shafts and a state in which the biasing force is not supplied to the shafts.

Preferably, at least one of the pull force exerted on the head box based on the operation of the operation cord, the weight of the sunlight shielding apparatus exerted on the head box, and a pull force with which a coupling of the coupling section of the operation cord is canceled is set with a safety factor taken into account.

According to the third aspect of the present invention, in a roll-up blind, a screen is suspended from a head box, a weight bar is suspended from a bottom of the screen, a lifting cord is wound around a lower part of the weight bar, an end of the lifting cord is fixed to the head box, and another end of the lifting cord is raised or lowered by a winding apparatus in the head box so as to wind up the screen around the weight bar or wind off to raise or lower the screen, and the head box is provided with an operation apparatus configured to rotate a driving shaft of the winding apparatus by means of an operation of an operation cord, wherein a cord joint is attached to the lifting cord, the cord joint being configured to enable the lifting cord to be split with a pull force which is greater than a pull force exerted in a usual operation of the operation cord, and the operation apparatus is provided with a transmission torque limiting apparatus configured to interrupt transmission of an operation force to the driving shaft in advance of a division of the cord joint.

Preferably, the operation apparatus is provided with a pulley on which the operation cord is mounted, and a torque limiter is interposed, as the transmission torque limiting apparatus, between the pulley and the driving shaft, the torque limiter being configured to inhibit the division of the cord joint due to the operation of the operation cord.

Preferably, the operation apparatus is provided with a pulley on which the operation cord is mounted, the operation cord is provided with a coupling section configured to couple the operation cord into an endless type, and the coupling section is provided with a retention force which breaks down in advance of the division of the cord joint when the operation cord is operated, so that the coupling section serves as the transmission torque-limiting apparatus.

Preferably, the retention force of the coupling section is set at a value higher than a retention force of the torque limiter.

Preferably, the cord joint is provided with a pair of joint main bodies configured to be attached with end portions of the lifting cord; fitting convex portions provided on the joint main bodies; and a coupling member configured to fit elastically with the fitting convex portions of the joint main bodies so as to couple the joint main bodies.

According to the fourth aspect of the present invention, an operation pulley capable of being assembled in an operation apparatus of a sunlight shielding apparatus is provided, the operation pulley comprising a tubular pulley; a ball chain configured to be mounted on the pulley; and a gear shaft or transmission shaft, wherein the ball chain is coupled via a coupling section into an endless type, the coupling section being configured to be decoupled with a predetermined first force, the pulley is provided, on an outer peripheral surface thereof, with a number of concavities configured to engage with balls of the ball chain, and, in an inward direction on an end surface of an input side, a flange formed integrally with the outer peripheral surface so as to be tubular toward an output side, and is engaged, at an opening on the output side, with the gear shaft or the transmission shaft so as to be capable of rotating relative to each other with friction, and a slippage torque between the pulley and the gear shaft or the transmission shaft is smaller than a first rotation torque exerted on the pulley with the first pull force.

Preferably, the gear shaft or the transmission shaft is provided with a tubular portion on the pulley side, the tubular portion being provided with a groove or a snap portion at a front end of a peripheral surface thereof, so that the gear shaft or the transmission shaft engages with the flange and is rotatably supported.

Preferably, the gear shaft obtains a friction force by being provided with a helical torsion spring in a tubular portion on the pulley side, and causes an end portion of the helical torsion spring to protrude in an outward direction so as to engage with an inner diameter of the pulley.

Preferably, a tubular cam member is provided so as to be capable of rotating and moving in an axial direction and a disc spring or a coil spring is disposed between the cam member and the pulley so as to bias them, whereby obtaining the friction force.

Effect of the Invention

According to the present invention, an operation cord or a lifting cord is provided where even if an excessive pull force is applied, hindrance of movement of a dweller or the like as well as breakage of the operation apparatus or the lifting apparatus can be prevented. More specifically, the following effects can be obtained through the first to third aspects of the present invention.

According to the first aspect of the invention, it is possible to provide an operation apparatus of a sunlight shielding apparatus which is equipped with a fail-safe function so as not to hinder behavior of a dweller or the like, and, in a usual operation, unnecessary activation of the fail-safe function is prevented, so that enhanced operability can be realized.

According to the second aspect of the invention, it is possible to provide an operation apparatus of a sunlight shielding apparatus where falling of the head box or breakage of the operation apparatus due to an operation of the operation cord can be prevented.

According to the third aspect of the invention, it is possible to provide a lifting apparatus of a roll-up blind which does not hinder a movement of a dweller or the like due to an accidental catch of the lifting cord, and which can prevent the lifting cord from splitting in a raising operation of the screen.

EMBODIMENTS FOR CARRYING OUT THE INVENTION

Figure 1:
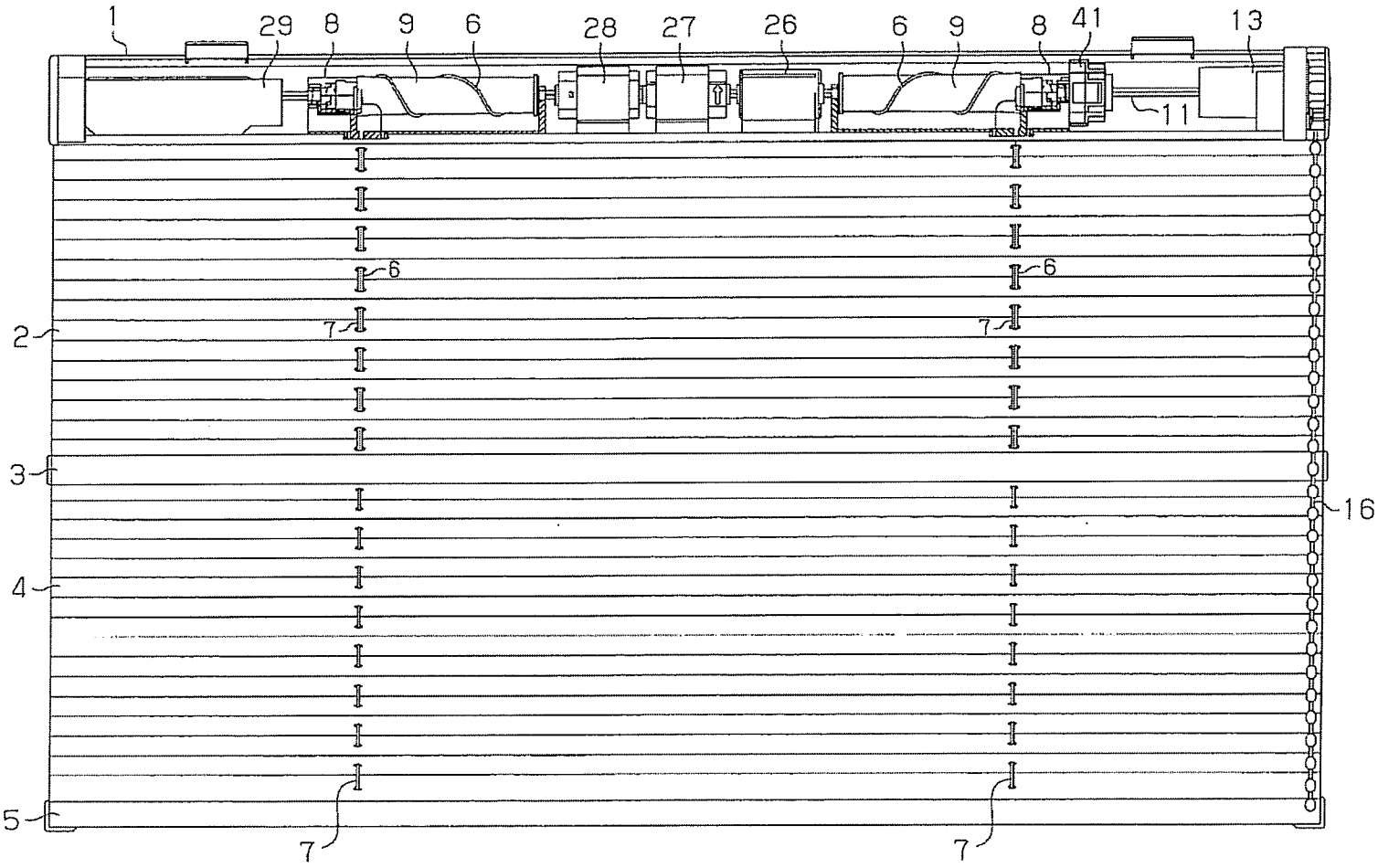
FIG. 1 is a front view of a pleated screen according to a first embodiment of a first aspect of the present invention.

Various embodiments of the present invention will be described below. Though embodiments based on the first to third aspects of the present invention will be described for convenience sake, embodiments having two or more of the features of the first to third aspects are also feasible. Accordingly, the embodiments based on the first to third aspects of the present invention shown below can be combined with one another. Also, as to the reference symbols assigned to the elements, same numbers are sometimes assigned to different elements in different embodiments.

First Embodiment of a First Aspect of the Present Invention

Hereafter a first embodiment of a first aspect of the present invention will be described according the drawings. In a pleated screen shown in FIGS. 1 and 2, an upper screen 2 is suspended from a head box 1, and a middle rail 3 is attached to a bottom end of the upper screen 2. A lower screen 4 is suspended from the middle rail 3, and a bottom rail 5 is attached to a bottom end of the lower screen 4.

The upper screen 2 is made of a translucent material such as a lace fabric so as to be foldable in a zigzag manner, and the lower screen 4 is made of a material having a light-shielding property so as to be foldable in a zigzag manner.

First and second lifting cords 6, 7 are inserted in both ends of the upper screen 2 in a width direction thereof, and the bottom end of the first lifting cord 6 is attached to the middle rail 3. The second lifting cord 7 passes through the middle rail 3 and is further inserted in the bottom screen 4 and a bottom end thereof is attached to the bottom rail 5.

Figure 2:
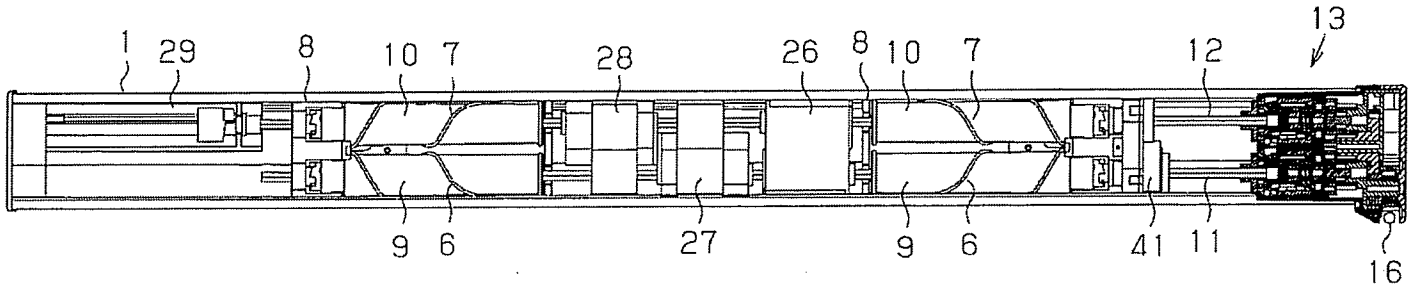
FIG. 2 is a plan view of the pleated screen according to the first embodiment of the first aspect of the present invention.

Top end portions of the first and second lifting cords 6, 7 are wound around first and second winding shafts 9, 10, respectively, and attached thereto, the first and second winding shafts 9, 10 being supported within the head box 1 by a supporting member 8 so as to be capable of rotating. That is, as shown in FIG. 2, the winding shafts 9, 10 are supported within the head box 1 so as to be capable of rotating by the supporting member 8 in a state where they extend in parallel to each other in a position above the first and second lifting cords 6, 7.

The top end portion of the first lifting cord 6 is wound around the first winding shaft 9, the top end portion of the second lifting cord 7 is wound around the second winding shaft 10, and the first and second lifting cords 6, 7 are wound in opposite directions to each other around the first and second winding shafts 9, 10. Further, the first and second lifting cords 6, 7 are so configured as to be wound up or wound off in a helical manner, based on rotations of the first and second winding shafts 9, 10.

A first driving shaft 11 of a hexagonal rod shape is inserted in the first winding shaft 9 so as not to be capable of rotating relative to each other, and similarly, a second driving shaft 12 of a hexagonal rod shape is inserted in the second winding shaft 10 so as not to be capable of rotating relative to each other. They are so configured that when the first driving shaft 11 is rotated in a direction for raising the first lifting cord 6, the first lifting cord 6 is wound up around the first winding shaft 9, and when the second driving shaft 12 is rotated in a direction for raising the second lifting cord 7, the second lifting cord 7 is wound up around the second winding shaft 10.

Figure 3:
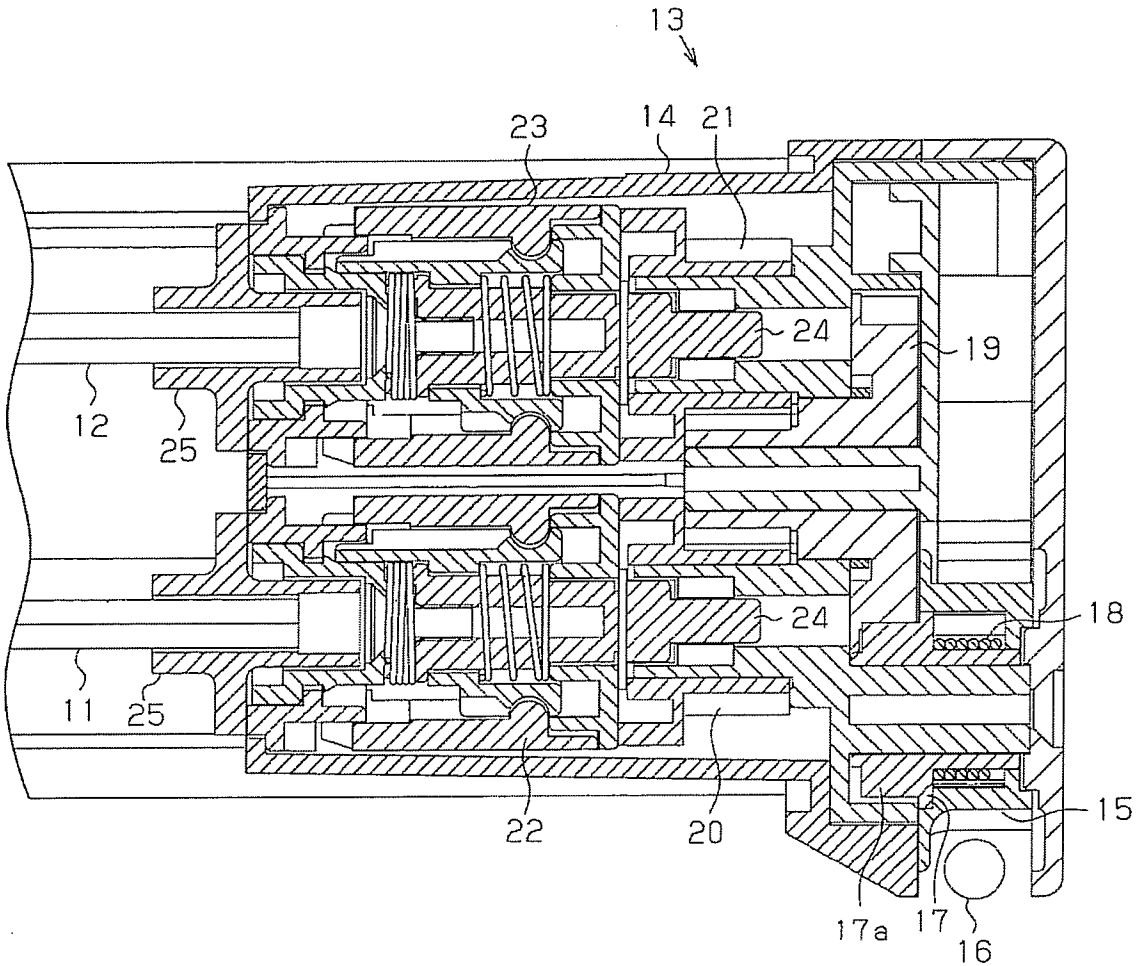
FIG. 3 is a sectional view of an operation apparatus according to the first embodiment of the first aspect of the present invention.

To one end portion of the head box 1 is attached an operation apparatus 13 configured to rotate the first and second driving shafts 11, 12. As shown in FIG. 3, a pulley 15 is supported so as to be capable of rotating on a base end side within a case 14 of the operation apparatus 13, and a ball chain 16 of an endless type is mounted on the pulley 15 and suspended downward therefrom. The pulley 15 can be operated to rotate by an operation of the ball chain 16.

Figure 4:
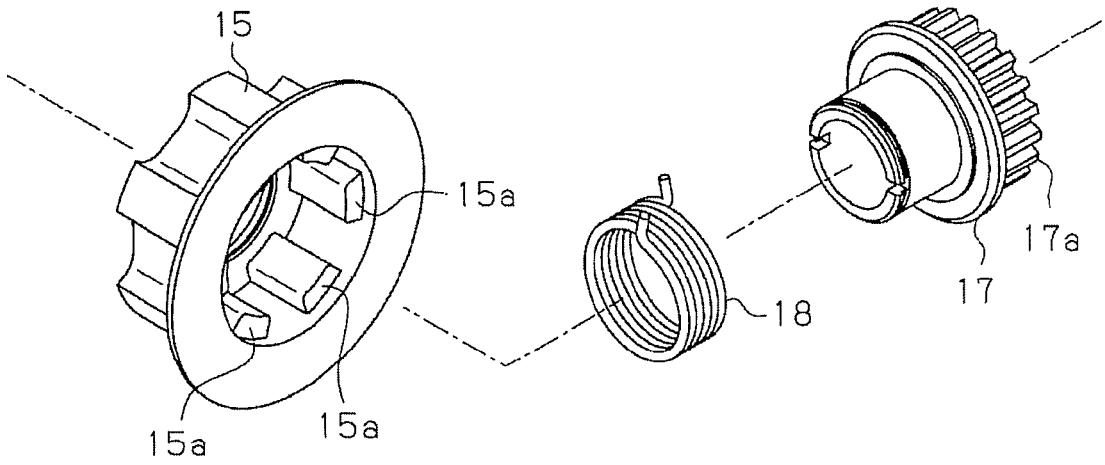
FIG. 4 is an exploded perspective view of a torque limiter according to the first embodiment of the first aspect of the present invention.
Figure 5:
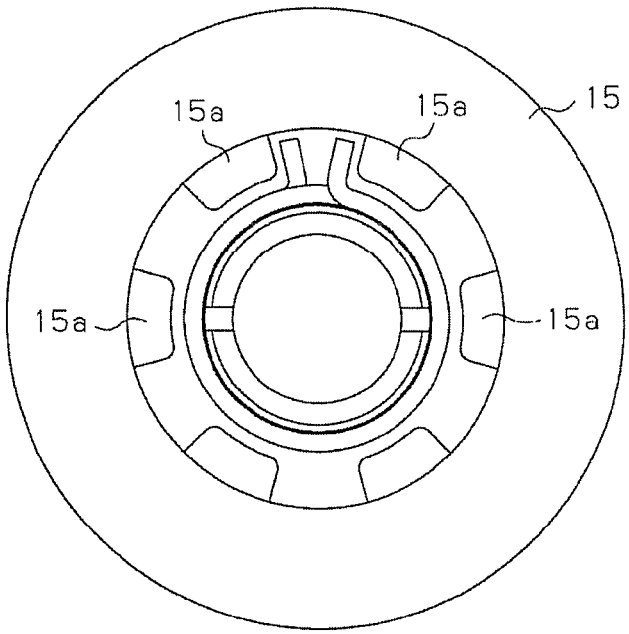
FIG. 5 is a front view of the torque limiter according to the first embodiment of the first aspect of the present invention.

As shown in FIG. 4, the pulley 15 is provided with a gear shaft 17 and a limit spring 18 composed of a helical torsion spring so as to be equipped with a function as a torque limiter. That is, the gear shaft 17 is supported so as to be capable of rotating by the case 14, and the limit spring 18 is mounted on an outer peripheral surface of the gear shaft 17. Further, the gear shaft 17 is inserted into the pulley 15 of a tubular shape, and, as shown in FIG. 5, both end portions of the limit spring 18 are engaged with locking portions 15*a* formed on an inner peripheral surface of the pulley 15.

In the above configuration, the pulley 15 and the gear shaft 17 are usually rotated integrally with each other based on a friction force between the limit spring 18 and the gear shaft 17. Further, in a state where a load exerted on the gear shaft 17 is increased and thus rotation of the gear shaft is inhibited, the limit spring 18 runs idle relative to the gear shaft 17.

A gear 17*a* is formed integrally with the gear shaft 17, and a transmitting gear 19 supported so as to be capable of rotating by the case 14 meshes with the gear 17*a*. Therefore, when the pulley 15 is rotated, the transmitting gear 19 is rotated.

A pair of first and second clutch gears 20, 21 mesh with the transmitting gear 19, the clutch gears 20, 21 being supported so as to be capable of rotating by the case 14 on both sides in a radial direction of the transmitting gear 19. When the transmitting gear 19 is rotated, the first and second clutch gears 20, 21 are rotated in a same direction.

In a front end side of the case 14, first and second transmitting clutches (clutch apparatuses) 22, 23 of a same configuration are housed, and input shafts 24 of the first and second transmitting clutches 22, 23 are fitted in central portions of the first and second clutch gears 20, 21. Therefore, when the first and second clutch gears 20, 21 are rotated, the input shafts 24 of the first and second transmitting clutches 22, 23 are rotated in a same direction.

The first and second transmitting clutches 22, 23 are each equipped with a known function of transmitting a rotation in only one direction of each of the input shafts 24 to each of output shafts 25, and the directions of rotations transmitted are opposite to each other. An end portion of the first driving shaft 11 is fitted in an output shaft 25 of the first transmitting clutch 22, and an end portion of the second driving shaft 12 is fitted in an output shaft 25 of the second transmitting clutch 23.

In the above configuration, when the ball chain 16 is rotated in one direction, only the second driving shaft 12 is rotated, so that the second winding shaft 10 is rotated in a direction for winding up the second lifting cord 7. Further, when the ball chain 16 is rotated in an opposite direction, only the first driving shaft 11 is rotated, so that the first winding shaft 9 is rotated in a direction for winding up the first lifting cord 6.

The first and second driving shafts 11, 12 are inserted in a stopper apparatus 26 at a middle portion of the head box 1. The stopper apparatus 26 has a known function of switching between a state in which self-weight falling of the middle rail 3 and the bottom rail 5 is prevented when the ball chain 16 is released after a raising operation of the middle rail 3 or the bottom rail 5 is performed and a state in which the self-weight falling of each of the middle rail 3 and the bottom rail is allowed.

As shown in FIGS. 1 and 2, the first and second driving shafts 11, 12 are inserted in a governor apparatuses 27, 28, respectively, at a position lateral to the stopper apparatus 26. The governor apparatuses 27, 28 control a rotation speed of the first and second driving shafts 11, 12 at or below a predetermined value so as to suppress a lowering speed of the middle rail 3 and the bottom rail 5 during their self-weight falling.

On another end portion of the head box 1 is disposed a lower limit apparatus 29 configured to set a maximum wound-off amount of the second lifting cord 7 from the second winding shaft 10 so as to set a lower limit position of the bottom rail 5.

Figure 6:
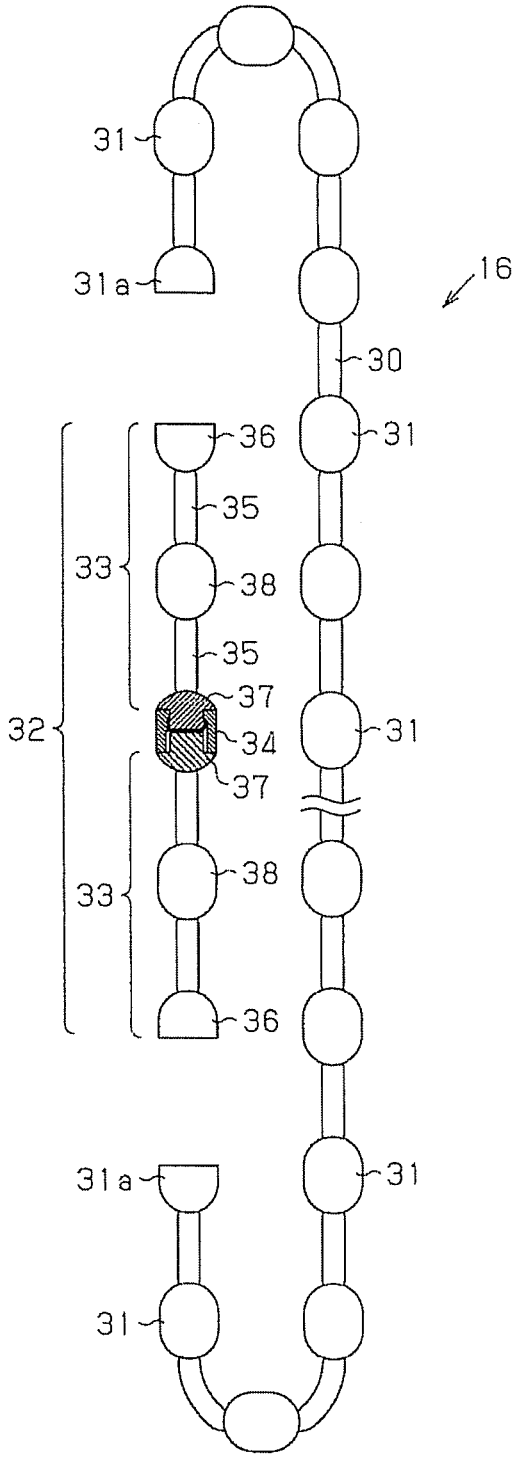
FIG. 6 is a front view of a ball chain according to the first embodiment of the first aspect of the present invention.
Figure 7:
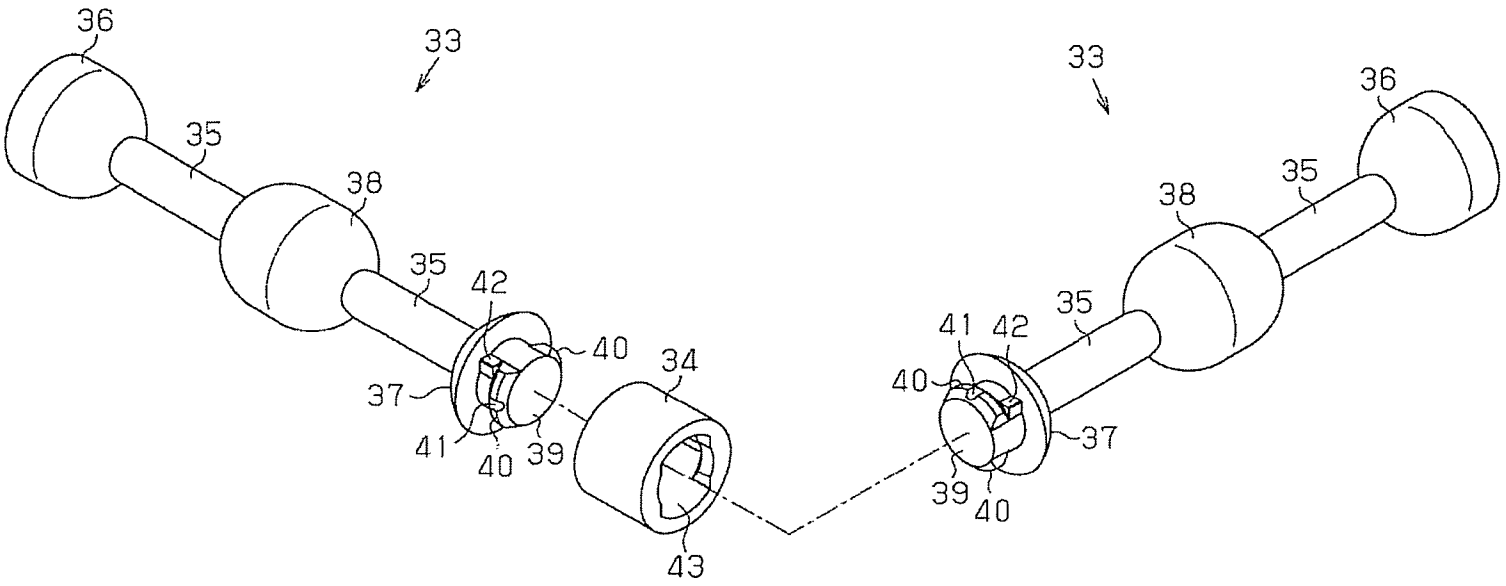
FIG. 7 is an exploded perspective view of a coupling section of the ball chain according to the first embodiment of the first aspect of the present invention.

Next, a specific configuration of the ball chain 16 will be described referring to FIGS. 6 and 7. As shown in FIG. 6, the ball chain 16 is provided with a cord 30 made of polyester, on which balls 31 are molded of a synthetic resin at regular intervals. Each of the balls 31 is formed such that a solid body of a prolate spheroid shape is formed by a molding machine on a surface of the cord 30, so that each ball 31 is fixed to the cord 30 immovably.

Both end portions of the cord 30 are coupled with each other via a coupling section 32, so that the ball chain 16 is formed into an endless type. As shown in FIG. 7, the coupling section 32 has a configuration where two first coupling members 33 of a same structure are coupled by means of a second coupling member 34 of a tubular shape.

The first coupling member 33 is configured such that a hemispherical portion 36 having a shape of a half of the ball 31 is formed through outsert molding on one end of a coupling cord 35 made of a same material as that of the cord 30, and a first fitting portion 37 is formed on another end. A ball 38 of a same shape as that of the ball 31 is fixed between the hemispherical portion 36 and the first fitting portion 37, and a distance between the first fitting portion 37 and the ball 38 as well as a distance between the ball 38 and the hemispherical portion 36 are identical with a distance between the balls 31.

The hemispherical portion 36 and the first fitting portion 37 are molded, on both end portions of the coupling cord 35, of a same synthetic resin as that of the ball 31. A base end portion of the first fitting portion 37 is formed into a same hemispherical shape as that of an end portion of the ball 31, and a fitting convex portion 39 of a round rod shape is formed through outsert molding on a front end portion of the first fitting portion 37.

On an outer peripheral surface of a front end portion of the fitting convex portion 39, diametrically swelled portions 40 are formed line-symmetrically with respect to a center of the round rod, and a groove 41 with a semicircular cross-section is formed at a middle position of each of the diametrically swelled portions 40. At a base end portion of the fitting convex portion 39, rotation restricting portions 42 each protruding in a radial direction of the round rod are formed line-symmetrically with respect to the center. Further, each rotation restricting portion 42 is formed in a position apart by 45 degrees from the groove 41 in a circumferential direction with respect to a center of the fitting convex portion 39.

The second coupling member 34 is molded of a same synthetic resin as that of the first fitting portion 37 and the balls 31, 38 into a tubular shape, and opening portions 43 on both sides are each formed into a log shape which allows a front end portion of the fitting convex portion 39 including the diametrically swelled portion 40 to be inserted therein. Further, the opening portions 43 are shaped such that directions of the log shapes are rotated by 90 degrees from each other with respect to the center of the tube.

In order to couple the first coupling member 33 and the second coupling member 34 together, the fitting convex portion 39 of the first fitting portion 37 is inserted into one of the opening portions 43 of the second coupling member 34, and subsequently, the first fitting portion 37 is rotated by 90 degrees in a clockwise direction relative to the second coupling member 34.

Also, in another opening portion 43 of the second coupling member 34, the fitting convex portion 39 of the first coupling member 33 is inserted and rotated by 90 degrees so as to be positioned. Thus, as shown in FIG. 6, the first coupling members 33 are coupled with each other with the second coupling member 34 in-between.

In this state, the diametrically swelled portion 40 of the fitting convex portion 39 of each first coupling member is held within the second coupling member 34. A holding force for this is set such that the fitting convex portion 39 does not come off from the second coupling member 34 with a force exerted thereon when one part of the ball chain 16 suspended from the pulley 15 is pulled down in a usual operation of raising or lowering the screen.

Further, in a case where a rotation of the first driving shaft 11 or the second driving shaft 12 is hindered, so that a force to operate the ball chain 16 is increased, whereby a rotation torque exerted on the pulley 15 by the force exceeds a slippage torque of a torque limiter incorporated in the pulley 15, the torque limiter is activated. Accordingly, the pulley 15 and the gear shaft 17 run idle, so that a large pull force is not applied to the ball chain 16. In an example, a maximum value of the slippage torque of the torque limiter is set at 65 N·cm, a radius of the pulley 15 is set at 10.2 mm, and a minimum value of a dividing force of the ball chain (corresponding to a first pull force) is set at 65 N. In this case, a torque exerted on the pulley 15 from the ball chain 16 is at least 66.3 N·cm, exceeding the slippage torque (65 N·cm) of the torque limiter, so that an excessive pull force is prevented from being applied to the coupling section 32 of the ball chain 16, which provides an advantage that unnecessary division of the coupling section 32 in a usual operation is prevented.

On the other hand, when the ball chain 16 is caught on a dweller or the like, so that a great pull force (first pull force; 65 N to 95 N in this embodiment) exceeding a usual pull force is applied to both parts of the ball chain 16 suspended from the pulley 15, the opening portion 43 is expanded by the diametrically swelled portions 40 of the fitting convex portion 39 due to elasticity of the synthetic resin of the second coupling member 34. Accordingly, the fitting convex portion 39 comes off from the second coupling member 34.

An outer shape in a state where the first fitting portions 37 are fitted on both sides of the second coupling member 34 is so set as to be same as that of the ball 31. The hemispherical portions 36 of the first coupling members 33 are fused to hemispherical portions 31 formed through outsert molding on both ends of the cord 30, so that balls having a same shape as that of the ball 31 are formed. When the first coupling members 33 are coupled with each other via the second coupling member 34, the ball chain 16 of an endless type is formed.

In the ball chain 16 thus configured, balls of a same shape are formed at regular intervals over an entire length of the cord 30 of the ball chain 16 and the coupling cord 35 of the coupling section 32. Therefore, the ball chain 16 can be rotated endlessly around the pulley 15.

Now, behavior of the pleated screen configured as described above will be described. When one part of the ball chain 16 is pulled down, only the second driving shaft 12 is rotated, so that the second lifting cord 7 is wound up around the second winding shaft 10, and thus, the bottom rail 5 is raised. When the ball chain 16 is released after the bottom rail 5 is raised to a desired level, the bottom rail 5 is held at the desired level due to the function of the stopper apparatus 26 for preventing self-weight falling.

When the ball chain 16 in this state is pulled in one direction and then released, the function for preventing self-weight falling of the stopper apparatus 26 is canceled, so that the bottom rail 5 is lowered due to self-weight falling. When the other part of the ball chain 16 is pulled down, only the first driving shaft 11 is rotated, so that the first lifting cord 6 is wound up around the first winding shaft 9, and thus, the middle rail 3 is raised. When the ball chain 16 is released after the middle rail 3 is raised to a desired level, the middle rail 3 is held at the desired level due to the function of the stopper apparatus 26 for preventing self-weight falling.

When the ball chain 16 in this state is pulled in the other direction and then released, the function for preventing self-weight falling of the stopper apparatus 26 is canceled, so that the middle rail 3 is lowered due to self-weight falling. With the pleated screen configured as described above, the following advantages are obtained.

(1) In a case where the ball chain 16 is caught on a dweller or the like, the first coupling member 33 and the second coupling member 34 in the coupling section 32 come off from each other. Therefore, the ball chain 16 can be equipped with a fail-safe function.

(2) In a case where a load on the first driving shaft 11 or the second driving shaft 12 is increased so as to hinder a rotation thereof in a usual operation, the pulley 15 runs idle relative to the gear shaft 17, so that an excessive pull force is prevented from being applied to the coupling section 32 of the ball chain 16. Therefore, unnecessary coming off of the coupling section 32 in a usual operation can be prevented.

(3) Since unnecessary coming off of the coupling section 32 in a usual operation can be prevented, it is possible to set the pull force low with which the coupling section 32 comes off, and thus, to cause the coupling section 32 to come off certainly when the ball chain 16 is caught on a dweller or the like.

(4) Since the pulley 15 is provided with a function of a torque limiter, even if an excessive pull force is applied to the ball chain 16, the pull force is absorbed by the torque limiter, so that it is never transmitted to a mechanism in the operation apparatus 13. Therefore, failure of the operation apparatus 13 due to an excessive pull force can be prevented from occurring.

Second Embodiment of a First Aspect of the Present Invention

Figure 8:
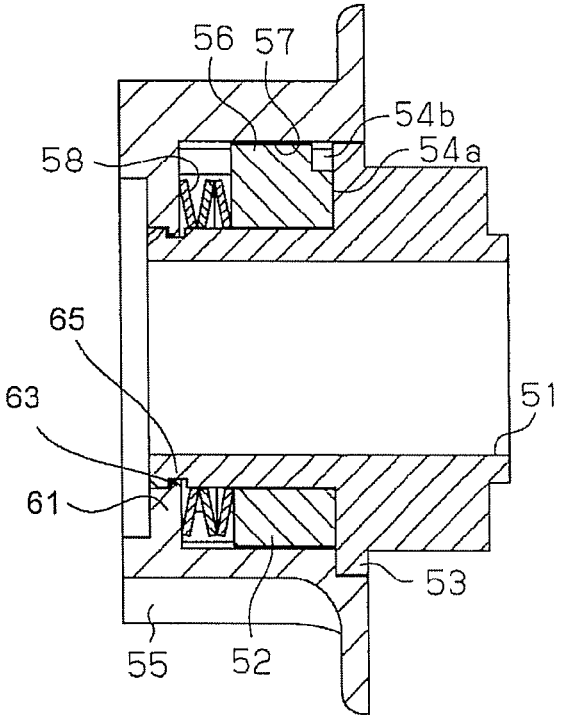
FIG. 8 is a sectional view of a torque limiter of a second embodiment of the first aspect of the present invention.
Figure 9:
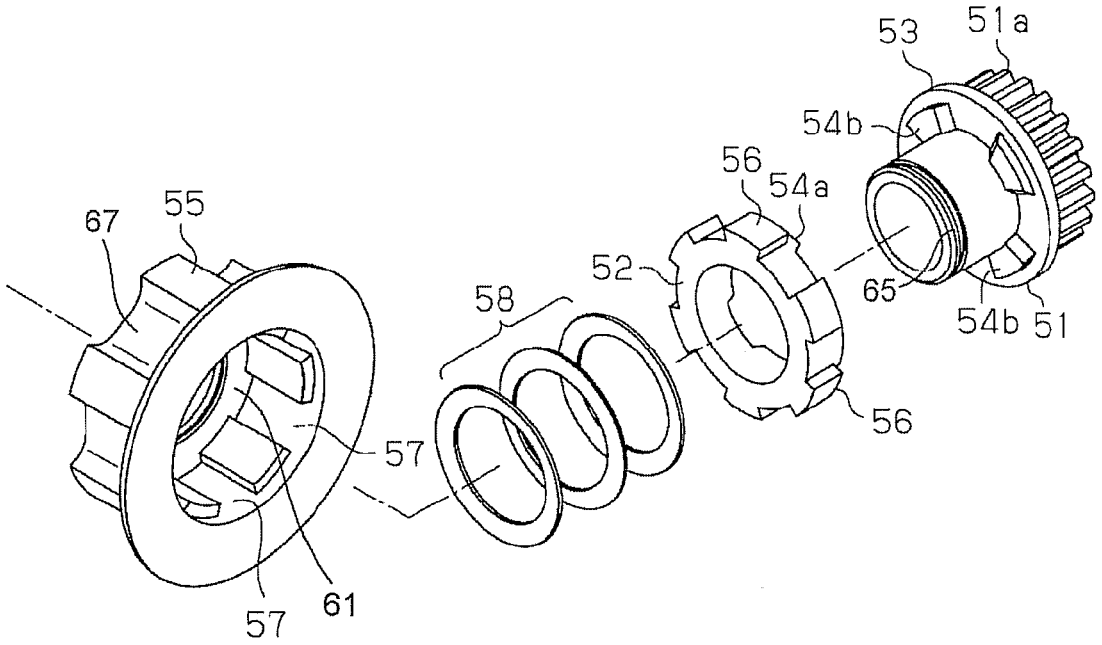
FIG. 9 is an exploded perspective view of the torque limiter of the second embodiment of the first aspect of the present invention.

FIGS. 8 and 9 show a second embodiment of a torque limiter. In the torque limiter of this embodiment, a disc spring is employed in place of the limit spring 18 of the first embodiment. In FIG. 8, the left side (pulley 55 side) is an input side and the right side (gear shaft 51 side) is an output side. The pulley 55 is provided, on an outer peripheral surface thereof, with a number of concave portions 67 configured to engage with the balls of the ball chain 16. A flange 61 is formed integrally with an outer peripheral surface on an end surface on the input side of the pulley 55 in an inward direction. The pulley 55 is shaped into tubular toward the output side. The pulley 55 is engaged, at an opening on the output side, with a gear shaft 51 with friction so as to be capable of rotating relative to each other. The pulley side of the gear shaft 51 is formed into a tubular shape, and a groove 65 is formed at front end of a peripheral surface thereof. A convex portion 63 is formed on the flange 61. The groove 65 and the convex portion 63 engage with each other, so that the gear shaft 51 is supported so as to be capable of rotating relative to the pulley 55.

In more detail, the gear shaft 51 is supported so as to be capable of rotating by a case 14 similar to that in the first embodiment, whose gear 51*a* meshes with the transmitting gear 19. A cam member 52 is supported on a front end side of the gear shaft 51 so as to be capable of rotating and moving in an axial direction of the gear shaft 51, and concave/convex portions 54*a*, 54*b* configured to be capable of meshing with each other in the direction of the gear shaft 51 are formed, respectively, on opposed side surfaces of the cam member 52 and a flange portion 53 of the gear shaft 51 in a circumferential direction.

A pulley 55 is fitted so as to be capable of rotating on a front end portion of the gear shaft 51, the pulley having a tubular shape covering the cam member 52. Convex portions 56 formed on an outer peripheral surface of the cam member 52 at regular intervals engage with concave portions 57 formed on an inner peripheral surface of the pulley 55, so that the cam member 52 is rotated integrally with the pulley 55 and supported so as to be capable of moving in an axial direction relative to the pulley 55.

A disc spring 58 is disposed between the cam member 52 and the pulley 55, and the cam member 52 is biased toward the flange portion 53 in a direction of the gear shaft 51 by the disc spring 58 using the pulley 55 as a fulcrum. Therefore, the concave/convex portions 54*a*, 54*b* of the cam member 52 and the flange portion 53 engage with each other due to a biasing force of the disc spring 58, so that a rotation of the pulley 55 is transmitted to the gear shaft 51 by way of the cam member 52.

Further, if a rotation of the gear shaft 51 is hindered, the cam member 52 runs idle relative to the gear shaft 51, with the concave/convex portion 54*a* of the cam member 52 hurdling the concave/convex portion 54*b* of the flange portion 53. Accordingly, even if an excessively great operation torque is exerted on the pulley 55, the operation torque is absorbed by the idle run of the cam member 52.

With the torque limiter configured as described above, advantages similar to those of the torque limiter in the first embodiment can be obtained, and the following advantage can be further obtained. (1) When the cam member 52 runs idle relative to the gear shaft 51, the concave/convex portion 54*a* of the cam member 52 runs idle while hurdling the concave/convex portion 54*b* of the flange portion 53 (torque ripple generation means). Therefore, the operator can know the idle run of the pulley 15 through a variation in an operation force to rotate the pulley 15 and collision noises generated continuously when the concave/convex portion 54*b* hurdles the concave/convex portion 54*b*.

The embodiment described above may be carried out in the following manners.

The ball chain may be replaced with an operation cord equipped with a fail-safe function.

Embodying is possible in a horizontal blind, a roll-up curtain, a vertical blind and the like other than the pleated screen.

A coil spring, a rubber material having elasticity may be used for the torque limiter in place of the limit spring and the disc spring.

Highly viscous oil may be filled between the pulley and the gear shaft to obtain a friction force.

Note that the first embodiment may be carried out in the following manners as examples of values realizing child safety.

Radius of the pulley 15: 30 mm;

Maximum value of operating torque (slippage torque) of the torque limiter: 40 N·cm;

Dividing force of the coupling section 32 of the ball chain 16: 15 N (Maximum torque exerted on the pulley from the chain is 45 N·cm).

Technical thoughts other than the claims that can be conceived of based on the embodiments above.

(Additional Statement 1)

An operation apparatus of a sunlight shielding apparatus in which an operation cord of an endless type is suspended from a pulley supported in a head box so as to be capable of rotating, and a driving shaft is rotated via the pulley based on an operation of the operation cord, whereby a shielding member is driven, wherein the pulley is provided with a torque limiter.

First Embodiment of a Second Aspect of the Present Invention

Figure 10:
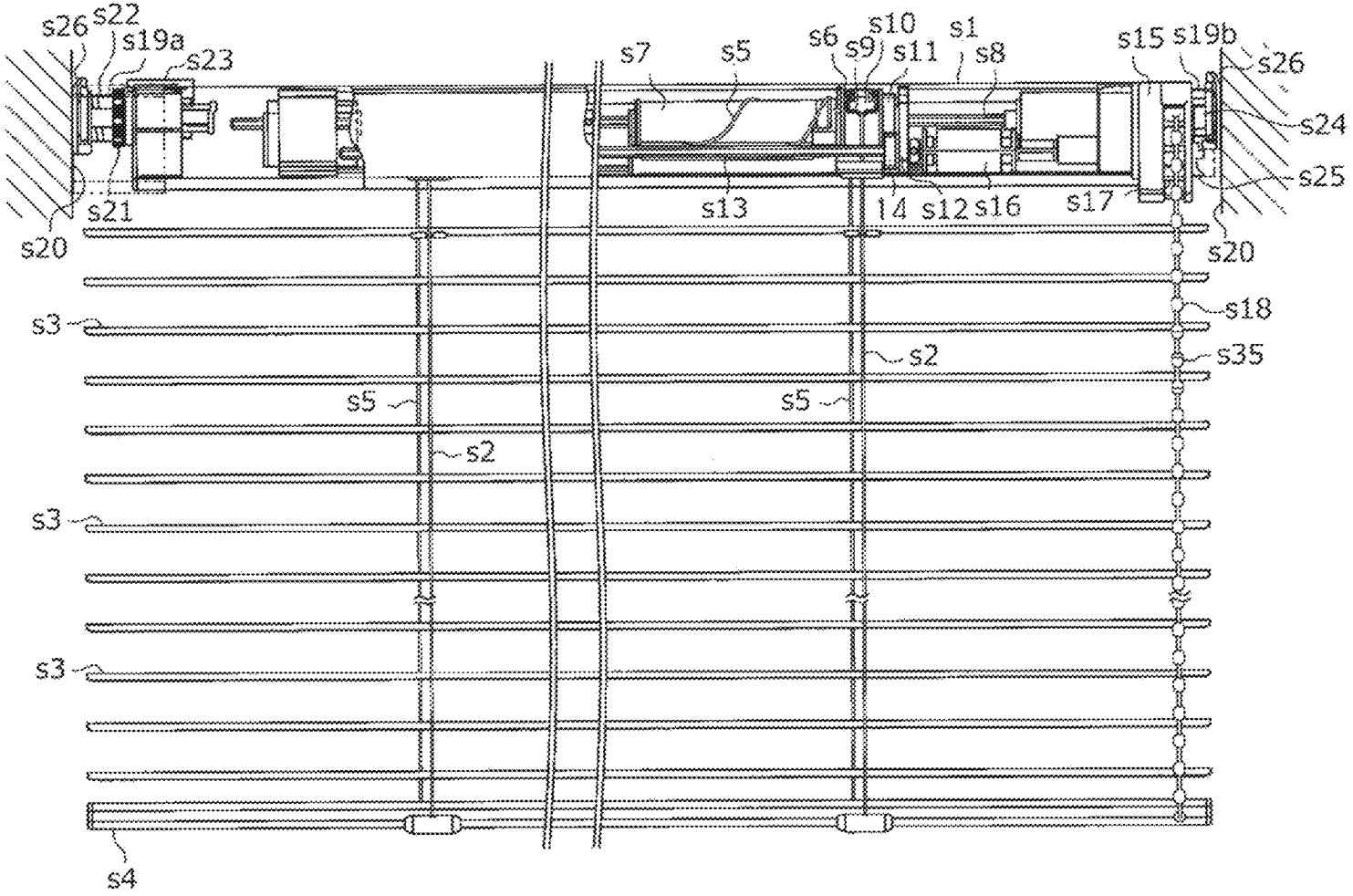
FIG. 10 is a front view of a horizontal blind of a first embodiment according to a second aspect of the present invention.
Figure 11:
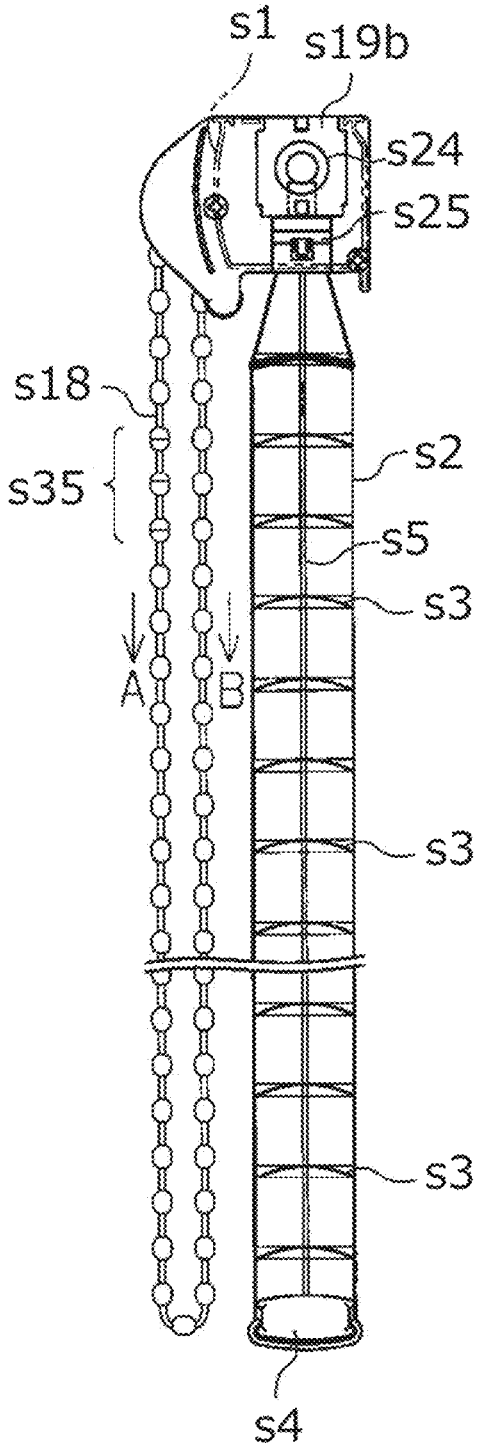
FIG. 11 is a side view of the horizontal blind of the first embodiment according to the second aspect of the present invention.
Figure 12:
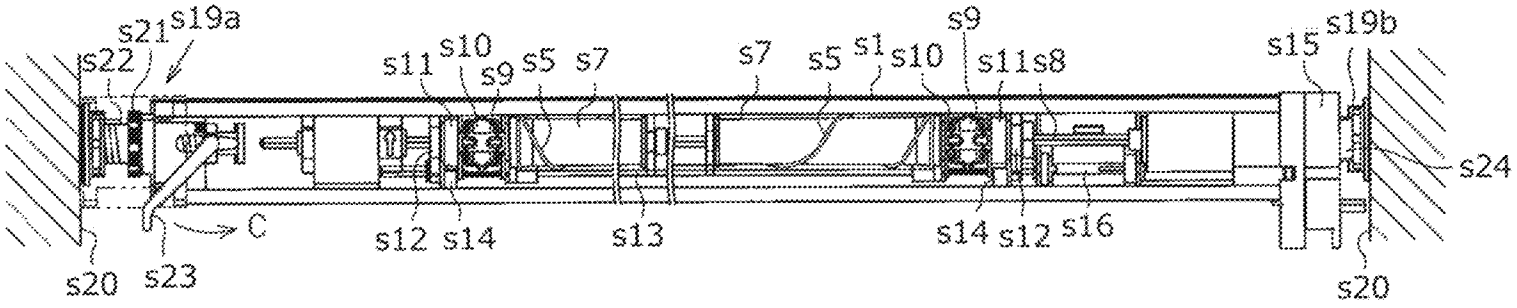
FIG. 12 is a plan view of the horizontal blind of the first embodiment according to the second aspect of the present invention.

Hereafter a first embodiment of a second aspect of the present invention will be described according to the drawings. Referring to FIGS. 10 to 12, a horizontal blind comprises a number of slats (sunlight shielding member) s3 supported by ladder cords s2 suspended from a head box s1 and a bottom rail s4 attached to bottoms of the ladder cords s2.

Lifting cords s5 are inserted through the slats s3 in a vicinity of supported positions by the ladder cords s2, and the bottom rail s4 are suspended from bottoms of the lifting cords s5. Top end portion of each lifting cord s5 is wound around a winding shaft s7 which is supported so as to be capable of rotating by a supporting member s6 disposed in the head box s1.

A lifting shaft s8 of a hexagonal rod shape is inserted in the winding shaft s7 so as not to be capable of rotating relative to each other. When the lifting shaft s8 is rotated, the winding shaft s7 is rotated, and when the winding shaft s7 is rotated in a direction for winding up the lifting cords s5, the lifting cords s5 are wound up around the winding shaft s7 in a helical manner, so that the bottom rail s4 and slats s3 are raised. When the winding shaft s7 is rotated in a direction for winding off the lifting cords s5, the lifting cords s5 are wound off, so that the bottom rail s4 and slats s3 are lowered.

Top end portion of each ladder cord s2 is attached to a tilt drum s10 by way of a hook s9, and the tilt drum s10 is supported so as to be capable of rotating at one end portion of the supporting member s6. A driven gear s11 of a spur gear is formed integrally on one side of the tilt drum s10.

At a position lateral to the supporting member s6, a support cap s12 is fixed to the head box s1, and the lifting shaft s8 is inserted through the support cap s12. At a position obliquely downward from the lifting shaft s8, i.e., in a lower corner portion of the head box s1, a tilt shaft s13 of a hexagonal rod shape is supported by the support cap 12 so as to be capable of rotating, and a driving gear s14 configured to mesh with the driven gear s11 is fitted with the tilt shaft s13 so as not to be capable of rotating. When the tilt shaft s13 is rotated, the tilt drum s10 is rotated by way of the driving gear s14 and the driven gear s11.

An end of the lifting shaft s8 is coupled with a first output shaft of an operation unit s15 which is attached to an end portion of the head box s1, and an end of the tilt shaft s13 is coupled with an output shaft of a tilt unit s16. Further, an input end of the tilt unit s16 is coupled with a second output shaft of the operation unit s15.

A pulley s17 is supported by an end portion of the operation unit s15, and a ball chain s18 is mounted on the pulley s17. When the ball chain s18 is operated to rotate the pulley s17 in a forward or rearward direction, the lifting shaft s8 and the tilt shaft s13 are rotated.

The operation unit s15 is equipped with a decelerating function of decelerating a rotation of the pulley s17 and then transmitting it to the lifting shaft s8 and the tilt unit s16, as well as a clutch function of switching between a state in which self-weight falling of the slats s3 and the bottom rail s4 is inhibited and a state in which the self-weight falling is allowed. The operation unit s15 is further equipped with a function of preventing the lifting shaft s8 from rotating while the tilt shaft s13 is rotated by way of the tilt unit s16.

The tilt unit s16 is equipped with functions of rotating the tilt shaft s13 based on a rotation of the second output shaft of the operation unit s15 and of not transmitting the rotation of the second output shaft to the tilt shaft s13 when the tilt shaft s13 is rotated by a predetermined angle, i.e., the slats are so rotated that a fully-closed or fully-opened state is attained.

Now, behavior of the horizontal blind provided with the operation unit s15 and the tilt unit s16 thus configured will be described. As shown in FIG. 11, when a part of the ball chain s18 suspended on a front side is pulled down (direction of arrow A), the tilt shaft s13 is rotated by way of the operation unit s15 and the tilt unit s16.

Then, the tilt drum s10 is rotated in accordance with a rotation of the tilt shaft s13, and the slats s3 are rotated by way of the ladder cords s2. At this time, the slats s3 are rotated such that convex surfaces thereof are located on an interior side of the room.

When the tilt shaft s13 is rotated by a predetermined angle, i.e., the slats s3 are rotated into the fully-opened state where they are almost vertical, a rotation of the tilt shaft s13 is stopped, due to an operation of the tilt unit s16, even if operation of the ball chain s18 in a same direction is continued.

Further, in a time period until the slats s3 reach the fully-closed state, the lifting shaft s8 is not rotated due to a working of the operation unit s15. After the slats s3 are rotated to the fully-closed state, when the ball chain s18 is further operated in the direction of arrow A, the lifting shaft s8 is rotated, so that the winding shaft s7 is rotated in the direction for winding up the lifting cords s5. Further, the lifting cords s5 are wound up around the winding shaft s7, so that the bottom rail s4 is raised, and the slats s3 are raised sequentially by the bottom rail s4.

When the ball chain s18 is released in a state in which the bottom rail s4 and the slats s3 are raised to a desired level, a rotation of the lifting shaft s8 in a direction for winding off the lifting cords is hindered due to a working of the operation unit s15, so that self-weight falling of the bottom rail s4 and the slats s3 is hindered and they are held at the desired level.

As shown in FIG. 11, when a part of the ball chain s18 on a rear side is pulled down (direction of arrow B), the tilt shaft s13 is rotated by way of the operation unit s15 and the tilt unit s16.

Then, the tilt drum s10 is rotated in accordance with a rotation of the tilt shaft s13, so that the slats s3 are rotated by way of the ladder cords s2. At this time, the slats s3 are rotated such that concave surfaces thereof are located on the interior side of the room.

When the tilt shaft s13 is rotated by a predetermined angle, i.e., when the slats s3 are rotated into a reverse fully-closed state where they are almost vertical, a rotation of the tilt shaft s13 is stopped, due to a working of the tilt unit s16, even if operation of the ball chain s18 in a same direction is continued.

In a time period until the slats s3 reach the reverse fully-closed state, the lifting shaft s8 is not rotated due to the working of the operation unit s15. After the slats s3 are rotated to the reverse fully-closed state, when the ball chain s18 is further pulled in the direction of arrow B, a rotation of the lifting shaft s8 in the direction for winding off the lifting cords is allowed due to a working of the operation unit s15, so that the bottom rail s4 and the slats s3 are lowered due to their self weights.

When, in a state in which the bottom rain s4 and the slats s3 are lowered to a desired level, the ball chain s18 is pulled in the direction of arrow A so as to set the slats s3 in the fully-closed state, and the ball chain s18 is pulled further in a same direction and then released, the operation unit s15 is set in a state to hinder a rotation of the lifting shaft s8 in a direction for winding off the lifting cords, so that the bottom rail s4 and the slats s3 are held at the desired level.

First and second fixing apparatuses s19*a*, s19*b* are attached to both ends of the head box s1, and the head box s1 is held between opposed wall surfaces s20 by way of the first and second fixing apparatuses s19*a*, s19*b*.

The first fixing apparatus s19*a* which is attached to a left end portion of the head box has an almost known configuration, where when an adjustment dial s21 is rotated in a forward or rearward direction, a pushing shaft s22 protrudes from or recedes into the head box s1.

When an operation lever s23 supported so as to be capable of rotating by the pushing shaft s22 is rotated in a direction of arrow C in FIG. 12, a biasing force of a coil spring is applied to a pushing shaft s22 due to a cam mechanism, so that the pushing shaft s22 is biased toward the opposed wall surface s20.

The second fixing apparatus s19*b* is composed of an adjustment shaft s24 which is supported so as to be capable of protruding from a case of the operation unit s15 toward the wall surface s20 and receding and a spacer s25 configured to adjust a protrusion length of the adjustment shaft s24. By sliding the spacer s25 in upward and downward directions, the protrusion length of the adjustment shaft s24 from the case of the operation unit s15 can be adjusted.

Bearing portions s26 are attached, by means of a double-faced adhesive tape or the like, to the wall surfaces s20 to which the head box s1 is attached, and the head box s1 is fixed between the bearing portions s26 by means of the first and second fixing apparatuses s19*a*, s19*b*.

In order to fix the head box s1 between the wall surfaces s20 by means of the first and second fixing apparatuses s19*a*, s19*b*, firstly, the head box s1 is held between the bearing portions s26, and in this state, both spaces between ends of the slats s3 and the wall surfaces s20 are adjusted so as to be approximately equal to each other through operations of the adjustment dial s21 and the adjustment shaft s24, and then, the head box s1 is held provisionally between the bearing portions s26.

Next, the operation lever s23 is rotated in the direction of arrow C in FIG. 12, so that the pushing shaft s22 is pressed against the bearing portion s26 with the biasing force of the coil spring, and the adjustment shaft s24 is pressed against the bearing portion s26 with a counteracting force. As a result, the head box s1 is held between the wall surfaces s20.

Further, in a case where a downward force of 30 N (Newton) is applied to pressed surfaces between the pushing shaft s22 and the adjustment shaft s24 and the bearing portions s26 due to a product weight, the pushing shaft s22 and the adjustment shaft s24 are set such that they are pushed against the bearing portions s26 with a constant force of about 60 N. Note that the force of 30 N applied to the pressed surfaces between the pushing shaft s22 and the adjustment shaft s24 and the bearing portions s26 is assumed to be a force that is applied when a window area covered by the product, i.e., a length as well as a number of the slats s3 are set to their maximum values.

Figure 13:
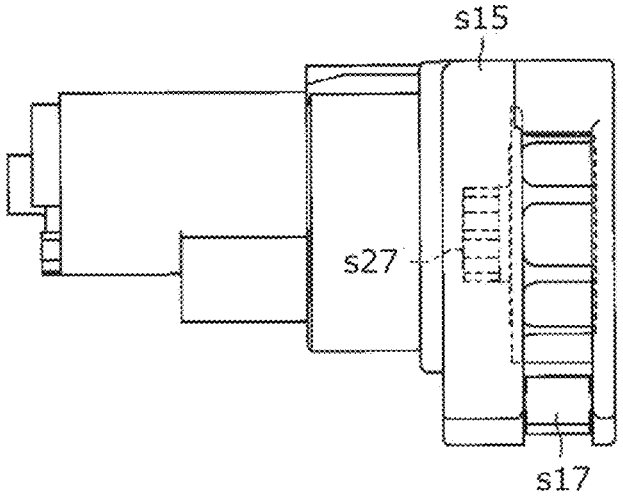
FIG. 13 is a front view of an operation unit of the first embodiment according to the second aspect of the present invention.

As shown in FIG. 13, a rotation of the pulley s17 is transmitted to a driving gear s27 which rotates about a same rotation axis as that of the pulley s17, and further transmitted from the driving gear s27 by way of the decelerating mechanism and the clutch mechanism to the output shaft of the operation unit s15.

Figure 14:
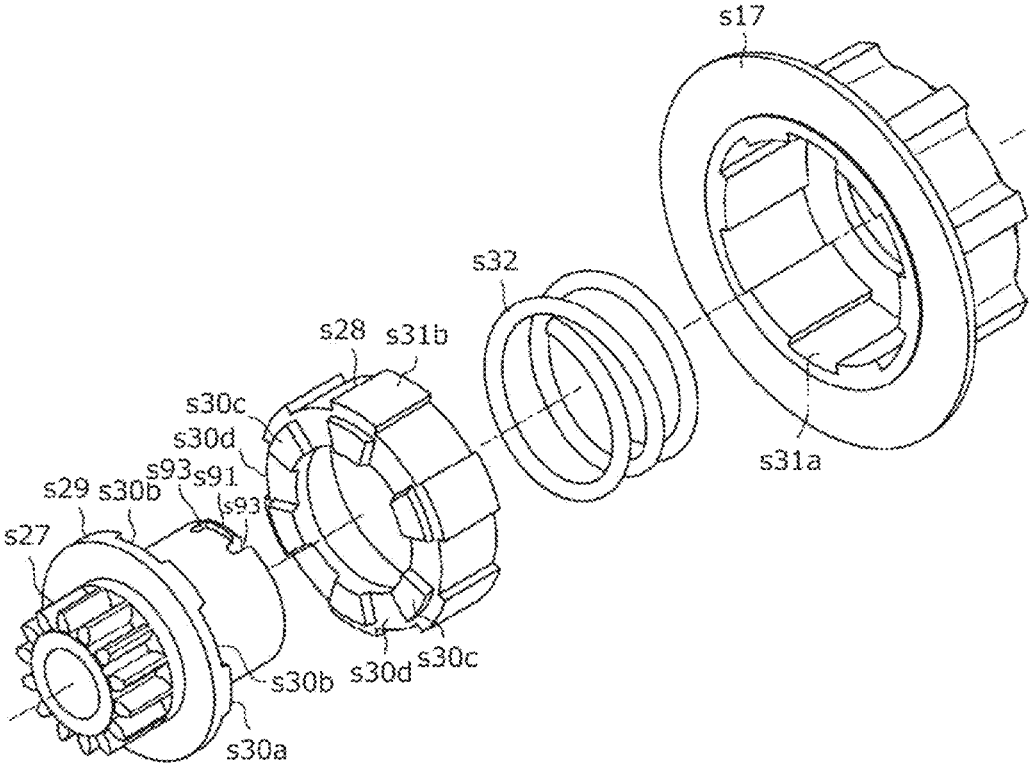
FIG. 14 is an exploded perspective view of a torque limiter of the first embodiment according to the second aspect of the present invention.

Between the pulley s17 and the driving gear s27 a torque limiter is disposed which is configured to set a rotation torque transmitted from the pulley s17 to the driving gear s27 at or below a certain value. Describing a specific configuration of the torque limiter, the pulley s17 and the driving gear s27 shown in FIG. 14 are supported so as to be capable of rotating about a same rotation axis and so as not to be capable of moving in a direction of the rotation axis by the case of the operation unit s15. A part of the driving gear s27 on a side of the pulley s17 is formed into a tubular shape, and a snap portion s91 is formed at a front end on a peripheral surface thereof. Slits s93 are formed on both sides of the snap portion s91 in a circumferential direction. The snap portion s91 engages with a convex portion formed on the flange of the pulley s17, so that the driving gear s27 is supported so as to be capable of rotating relative to the pulley s17.

On a base end side of the driving gear s27, a cam member s28 of a tubular shape is supported so as to be capable of rotating as well as moving in an axial direction of the driving gear s27, and on opposed side surfaces of a flange portion s29 of the driving gear s27 and the cam member s28, a concave/convex portion s30*b*, s30*a* and a concave/convex portion s30*d*, s30*c* configured to be capable of meshing with each other in an axial direction of the driving gear s27 are formed, respectively, at regular intervals (60 degrees interval with respect to a rotation axis).

The pulley s17 is formed into a tubular shape that can house the cam member s28, and concave/convex portions s31*a*, s31*b* configured to mesh with each other are formed on an inner peripheral surface of the pulley s17 and an outer peripheral surface of the cam member s28, respectively, at regular intervals in a circumferential direction. The cam member s28 is configured so as to be capable of moving relative to the pulley s17 in an axial direction of the driving gear s27 and so as not to be rotating relative to the pulley due to a fitting of the concave/convex portions s31*a*, s31*b*.

Figure 15:
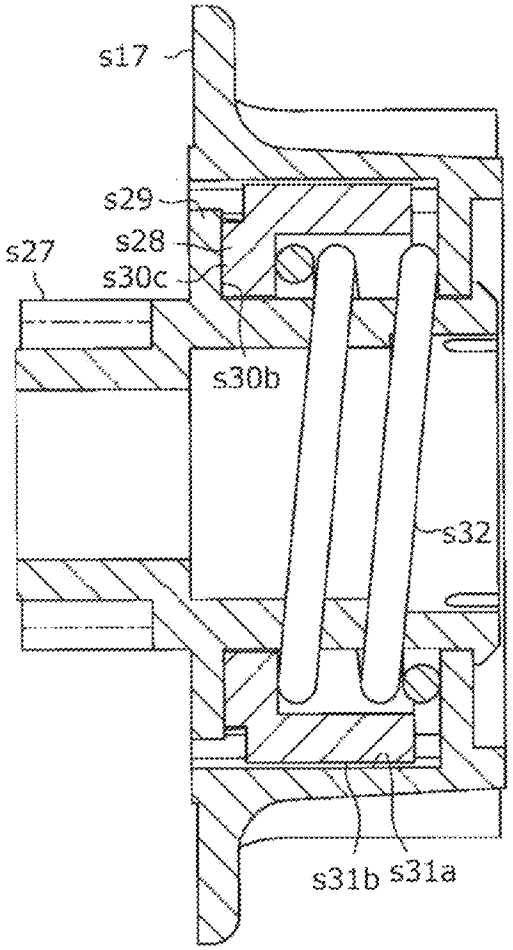
FIG. 15 is a sectional view of the torque limiter of the first embodiment according to the second aspect of the present invention.

A coil spring s32 is disposed in the cam member s28, and, as shown in FIG. 15, one end of the coil spring s32 abuts on the pulley s17 and another end abuts on the cam member s28. The cam member s28 is biased toward the flange portion s29 of the driving gear s27 due to a biasing force of the coil spring s32 using the pulley s17 as a fulcrum, so that the concave/convex portion s30*b*, s30*a* and the concave/convex portion s30*d*, s30*c* are held at positions where they mesh with each other. In this state, the pulley s17 and the driving gear s27 are rotated integrally.

Figure 16:
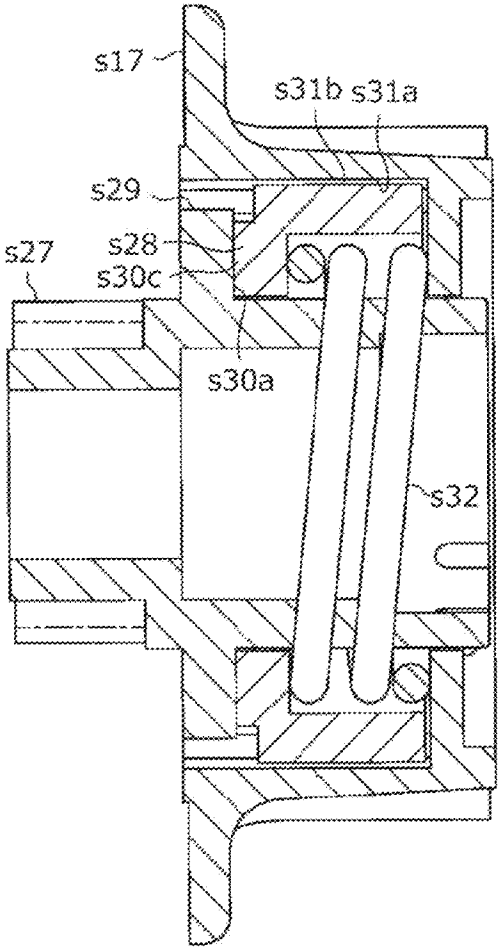
FIG. 16 is a sectional view showing an operation of the torque limiter of the first embodiment according to the second aspect of the present invention.

If a rotation torque greater than the certain value is exerted on the pulley s17 in a state in which a rotation of the driving gear s27 is hindered, as shown in FIG. 16, the cam member s28 moves toward the pulley s17 against the biasing force of the coil spring s32, so that meshing between the concave/convex portions s30*a*-30*d* are canceled, and thus, the cam member s28 runs idle relative to the driving gear s27. Every time the cam member s28 rotates by s60 degrees, meshing of the concave/convex portions s30*a*-30*d* and cancellation thereof are repeated, so that the cam member s28 runs idle relative to the driving gear s27.

The cancellation of the meshing of the concave/convex portions s30*a*-30*d* is so set as to occur when the ball chain s18 is pulled downward with a force exceeding 60 N-70 N taking a tolerance of the torque limiter into account.

Figure 17:
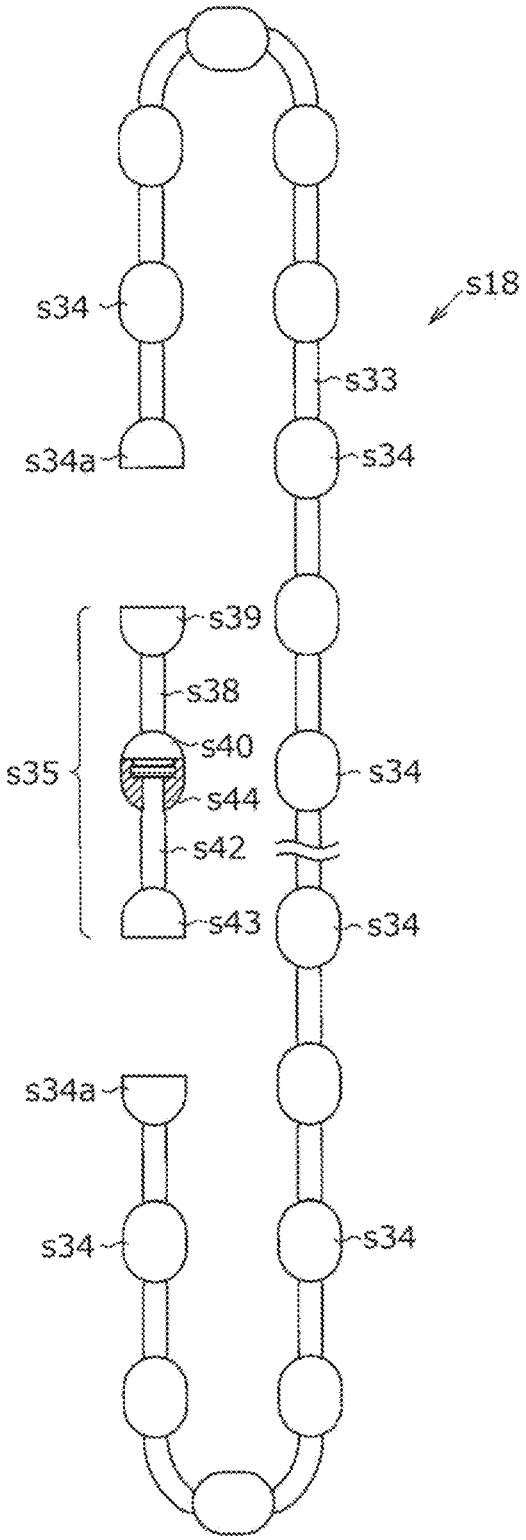
FIG. 17 is a front view of a ball chain of the first embodiment according to the second aspect of the present invention.

As shown in FIG. 17, the ball chain s18 comprises a cord s33 of a polyester and balls s34 of a synthetic resin molded on the cord s33 at regular intervals. Each of the balls s34 is formed such that a solid body of a prolate spheroid shape is formed by a molding machine on a surface of the cord s33, so that each ball s34 is fixed to the cord s33 immovably.

Figure 18:
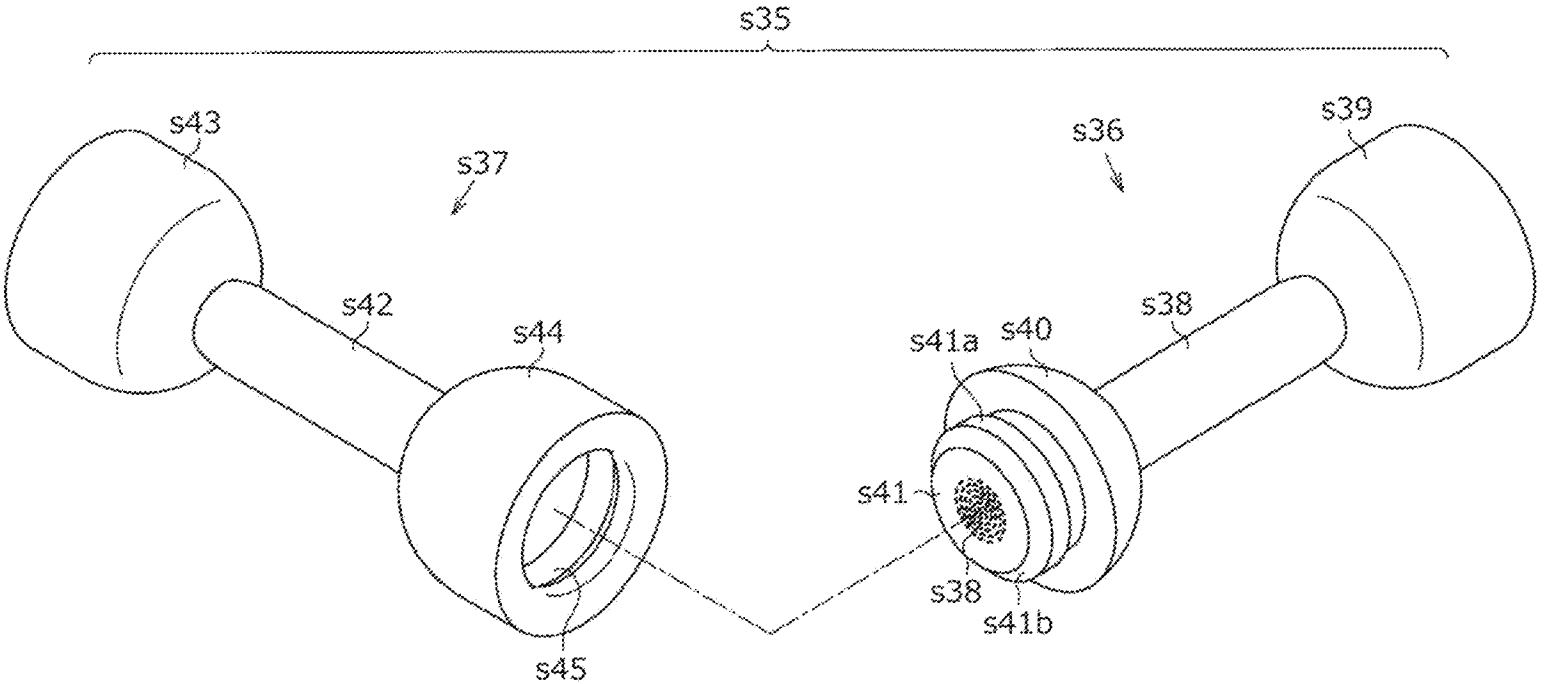
FIG. 18 is an exploded perspective view of a coupling section of the ball chain of the first embodiment according to the second aspect of the present invention.

Both end portions of the cord s33 are coupled with each other via a coupling section s35, so that the ball chain s18 is formed into an endless type. As shown in FIG. 18, the coupling section s35 is composed of a first coupling member s36 and a second coupling member s37.

The first coupling member s36 is configured, as shown in FIG. 18, such that a hemispherical portion s39 with a shape slightly larger than a half of the ball s34 is formed through outsert molding on one end of a coupling cord s38 of a same material as that of the cord s33, and a first fitting portion s40 is formed so as to be solid to tip thereof through outsert molding on another end of the coupling cord. The distance between the hemispherical portion s39 and the first fitting portion s40 is identical with a distance between the balls s34.

A base end portion of the first fitting portion s40 is formed into a hemispherical shape similar to an end portion of the ball s34, and a fitting convex portion s41 of a round rod shape is formed on a front end portion of the first fitting portion s40. A diametrically swelled portion s41*a* of a flange shape is formed at a front end portion of the fitting convex portion s41, and an outer diameter of the diametrically swelled portion s41*a* is smaller than a maximum diameter of a base end portion of a hemispherical shape. A corner portion on a front end side of the diametrically swelled portion s41*a* is made into a chamfered portion s41*b*.

The second coupling member s37 is configured such that a hemispherical portion s43 of a shape of a half of the ball s34 is formed on one end of a coupling cord s42 of a same material as that of the cord s33, and a second fitting portion s44 is formed on another end of the coupling cord s42. The distance between the hemispherical portion s43 and the second fitting portion s44 is identical with the distance between the balls s34.

The hemispherical portion s43 and the second fitting portion s44 are formed of a same material as that of the ball s34 through outsert molding at the both end portions of the cord s33. A base end portion of the second fitting portion s44 is formed into a hemispherical shape similar to the end portion of the ball s34, and a fitting hole s45 is formed at a front end portion of the second fitting portion s44. A diameter of an innermost portion of the fitting hole s45 is made larger than a diameter of an opening portion thereof so as to fit elastically with the diametrically swelled portion s41*a* of the fitting convex portion s41 and to hold it.

A depth of the fitting hole s45 is made smaller than a half of a length of the second fitting portion s44, and the fitting convex portion s41 protrudes by a length equal to the depths of the fitting hole s45. A holding force of the fitting hole s45 holding the fitting convex portion s41 is set such that a fitting between the fitting convex portion s41 and the fitting hole s45 is not broken with a usual pull force applied to the ball chain s18 in operations of raising the slats and adjusting an angle of the slats.

Only when a great pull force exceeding the usual pull force is applied to the ball chain s18, the fitting between the fitting convex portion s41 and the fitting hole s45 is broken due to elasticity of the synthetic resin. In this embodiment, the fitting between the fitting convex portion s41 and the fitting hole s45 is so set as to be broken with a pull force exceeding a range of 80 N to 90 N.

The hemispherical portions s39, s43 of the first and second coupling members s36, s37 are fused to hemispherical portions s34*a* formed at both ends of the cord s33, so that balls of a same shape as that of the ball s34 are formed. When the fitting convex portion s41 is fitted in the fitting hole s45, the ball chain s18 of a endless type is formed.

The horizontal blind configured as described above is set as follows. Assuming that a pull force of the ball chain s18 with which the torque limiter begins to operate is T, a weight of the blind applied to the first and second fixing apparatuses s19*a*, s19*b* is W, and a holding force to hold the head box s1 between the wall surfaces s20 with the pushing force of the first and second fixing apparatuses s19*a*, s19*b* is S, a relation of T+W<S is satisfied. When T is 70 N and W is 30 N, the holding force S is set at a value exceeding 100 N.

Further, assuming that a pull force with which the coupling section s35 of the ball chain s18 is divided is C, a relation of C+W<S is satisfied. Taking a safety factor into account for the pull force of the ball chain s18 with which the torque limiter begins to operate, a relation of (T×safety factor)+W<S may be satisfied. The safety factor is set at "3", for example, at "5" talking into account decrease in the pushing force of the first and second fixing apparatuses s19*a*, s19*b*, or at "10" taking into account a situation where the ball chain s18 is pulled quickly and furiously.

Further, estimating the safety factor as T+W, a relation of (T+W)×safety factor<S may be set. When T is 70 N, W is 30 N and the safety factor is s3, the holding force S is set at 400 N or so.

Relations of T (70 N)+W (30 N)<S (110 N) and C (90 N)+W (30 N)<S (140 N) may be both satisfied and further a safety factor as described above may be taken into account.

Now, behavior of the operation unit s15 configured as described above will be described. When the ball chain s18 is operated in the direction of arrow A shown in FIG. 11, the slats s3 are rotated first in the direction of the fully-closed state, and subsequently the slats s3 are raised. When the ball chain s18 is released after the slats s3 are raised to a desired level, self-weight falling of the slats s3 and the bottom rail s4 is hindered, so that the slats s3 are held at the desired level.

When the ball chain s18 is operated in the direction of arrow B shown in FIG. 11, the slats s3 are rotated in the direction of the reverse fully-closed state. When the ball chain s18 is further operated in a same direction after the slats s3 are rotated to the reverse fully-closed state, the slats s3 are lowered due to self-weight falling.

When the slats s3 are raised to their upper limit, or when the ball chain s18 is operated in the direction for raising the slats s3 in a state in which raising of the slats is impossible because of a certain obstacle, if a pull force exerted on the ball chain s18 exceeds 70 N, the cam member s28 runs idle within the operation unit s15 relative to the driving gear s27.

With the horizontal blind configured as described above, the following advantages are obtained.

(1) Even if an excessively great pull force is applied to the ball chain s18, breakage of the operation unit s15 and the slat lifting mechanism can be prevented thanks to idle run of the driving gear s27 and the cam member s28 within the operation unit s15.

(2) Due to the idle run of the driving gear s27 and the cam member s28 within the operation unit s15, a pull force applied downwardly to the head box s1 based on an operation of the ball chain s18 can be made at 55 N or below in this embodiment.

(3) A total of a weight applied to the head box s1 and a pull force applied downwardly to the head box s1 based on an operation of the ball chain s18 can be made smaller than a pushing force for supporting the head box s1 between the wall surfaces s20 by means of the first and second fixing apparatuses s19*a*, s19*b*. Accordingly, falling down of the head box s1 during operation of the ball chain s18 can be prevented from occurring.

(4) By setting a pull force with which fitting of the coupling section s35 of the ball chain s18 is broken smaller than a pushing force for supporting the head box s1 between the wall surfaces s20, when a excessively great pull force is applied to the ball chain s18, the fitting of the coupling section s35 can be broken, so that falling down of the head box s1 can be prevented from occurring.

Second Embodiment of a Second Aspect of the Present Invention

Figure 19:
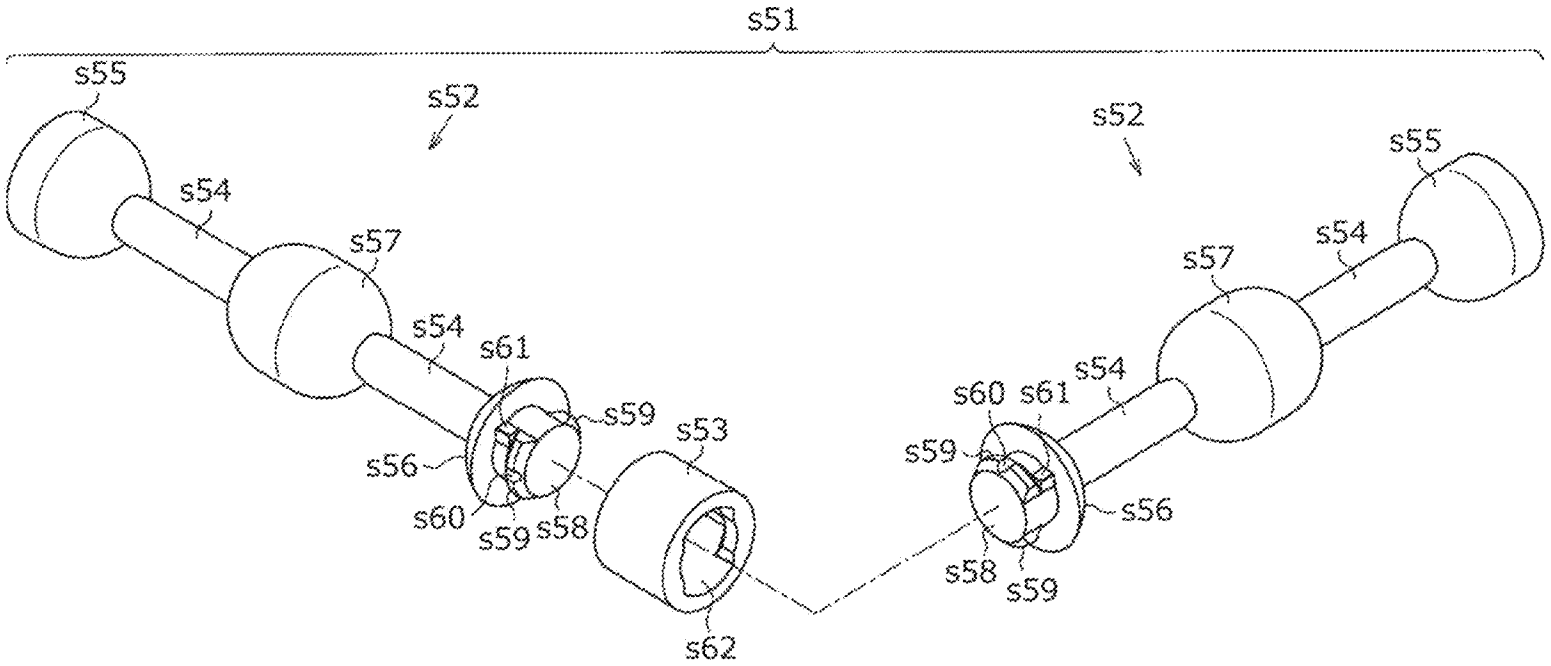
FIG. 19 is an exploded perspective view of another coupling section of the ball chain of a second embodiment according to the second aspect of the present invention.

FIG. 19 shows another example of a coupling section of the ball chain s18. The coupling section s51 has a configuration where two first coupling members s52 of a same structure are coupled by means of a second coupling member s53 of a tubular shape.

The first coupling member s52 is configured such that a hemispherical portion s55 having a shape of a half of the ball s34 is formed through outsert molding on one end of a coupling cord s54 made of a same material as that of the cord s33, and a first fitting portion s56 is formed on another end. A ball s57 of a same shape as that of the ball s34 is fixed between the hemispherical portion s55 and the first fitting portion s56, and a distance between the first fitting portion s56 and the ball s57 as well as a distance between the ball s57 and the hemispherical portion s55 are identical with a distance between the balls s34.

The hemispherical portion s55 and the first fitting portion s56 are molded, on both end portions of the coupling cord s54, of a same synthetic resin as that of the ball s34. A base end portion of the first fitting portion s56 is formed into a same hemispherical shape as that of an end portion of the ball s34, and a fitting convex portion s58 of a round rod shape is formed through outsert molding on a front end portion of the first fitting portion s56.

On an outer peripheral surface of a front end portion of the fitting convex portion s58, diametrically swelled portions s59 are formed line-symmetrically with respect to a center of the round rod, and a groove s60 with a semicircular cross-section is formed at a middle position of each of the diametrically swelled portions s59. At a base end portion of the fitting convex portion s58, rotation restricting portions s61 each protruding in a radial direction of the round rod are formed line-symmetrically with respect to the center. Further, each rotation restricting portion s61 is formed in a position apart by s45 degrees from the groove s60 in a circumferential direction with respect to a center of the fitting convex portion s58.

The second coupling member s53 is molded of a same synthetic resin as that of the first fitting portion s56 and the balls s34, s57 into a tubular shape, and opening portions s62 on both sides are each formed into a log shape which allows a front end portion of the fitting convex portion s58 including the diametrically swelled portion s59 to be inserted therein. Further, the opening portions s62 are shaped such that directions of the log shapes are rotated by s90 degrees from each other with respect to the center of the tube.

In order to couple the first coupling member s52 and the second coupling member s53, the fitting convex portion s58 of the first fitting portion s56 is inserted into one of the opening portions s62 of the second coupling member s53, and subsequently, the first fitting portion s56 is rotated by s90 degrees in a clockwise direction relative to the second coupling member s53.

Also, in another opening portion s62 of the second coupling member s53, the fitting convex portion s58 of the first coupling member s52 is inserted and rotated by s90 degrees so as to be positioned. Thus, the first coupling members s52 are coupled with each other with the second coupling member s53 in-between.

In this state, the diametrically swelled portion s59 of the fitting convex portion s58 of each first coupling member s52 is held within the second coupling member s53. A holding force for this is set such that the fitting convex portion s58 does not come off from the second coupling member s53 with a usual pull force exerted thereon when one part of the ball chain s18 is pulled down in a usual operation.

The hemispherical portions s55 of the first coupling members s52 are fused to hemispherical portions s34*a* formed through outsert molding on both ends of the cord s33, so that balls having a same shape as that of the ball s34 are formed. When the first coupling members s52 are coupled with each other via the second coupling member s53, the ball chain s18 of an endless type is formed.

In this ball chain s18, if an operation of raising the slats s3 is hindered during a usual operation, so that a pull force to operate the ball chain s18 becomes large (60 N to 70 N in this embodiment), a torque limiter incorporated in the pulley s17 is activated. That is, the pulley s17 and the driving gear s27 run idle relative to each other, so that an excessive pull force is not applied to the ball chain s18.

On the other hand, when the ball chain s18 is caught on a dweller or the like, so that a great pull force (80 N to 100 N in this embodiment) exceeding a normal pull force is applied to both parts of the ball chain s18 suspended from the pulley s17, the opening portion s62 is expanded by the diametrically swelled portions s59 of the fitting convex portion s58 due to elasticity of the synthetic resin of the second coupling member s53. Accordingly, the fitting convex portion s58 comes off from the second coupling member s53.

In the ball chain s18 thus configured, balls of a same shape are formed at regular intervals over an entire length of the cord s33 of the ball chain s18 and the coupling cord s54 of the coupling section s51. Therefore, the ball chain s18 can be rotated endlessly around the pulley s17.

The embodiment described above may be carried out in the following manners.

Embodying is possible in a roll blind, a roll-up curtain, and a pleated curtain other than the horizontal blind.

The ball chain s18 may be replaced with an operation cord having a coupling section that is divided with a pull force of a predetermined value or more.

An Embodiment of a Third Aspect of the Present Invention

Figure 20:
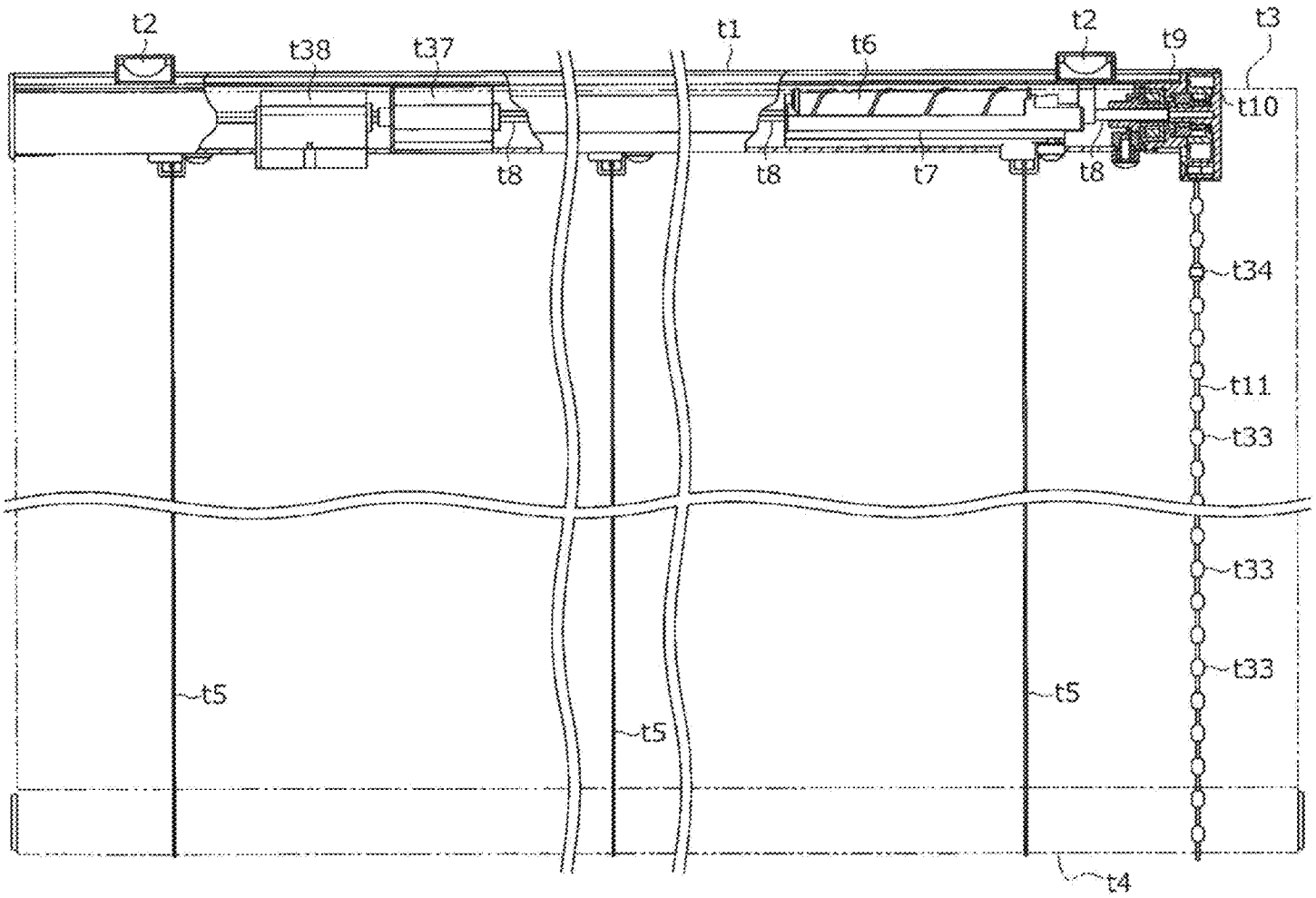
FIG. 20 is a front view of a roll-up blind of an embodiment according to a third aspect of the present invention.
Figure 21:
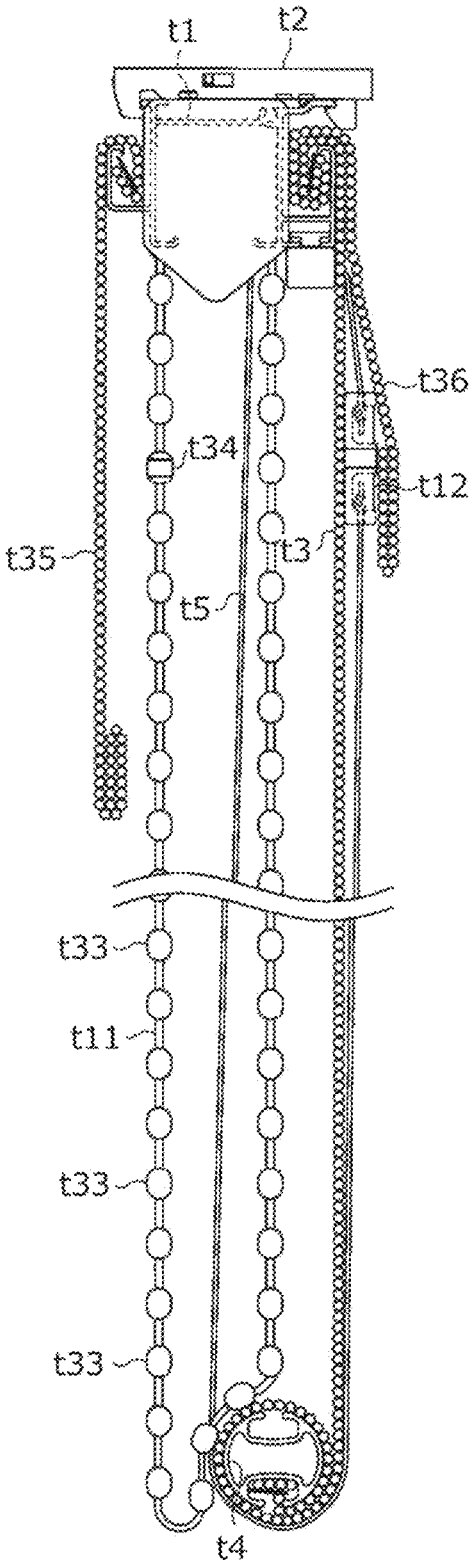
FIG. 21 is a side view of the roll-up blind of the embodiment according to the third aspect of the present invention.

Hereafter an embodiment of a third aspect of the present invention will be described according to the drawing. In a roll-up blind shown in FIGS. 20 and 21, a head box t1 is attached to an attachment surface via brackets t2, and a top end of a screen t3 composed of a chip-blind is attached to a rear surface of the head box t1.

A weight bar t4 formed of a material having a tubular shape is attached to a bottom end of the screen t3. A plurality of lifting cords t5 configured to raise and lower the weight bar t4 are attached, at an end portion thereof, to the rear surface of the head box t1, and another end portion is attached, by way of a position below the weight bar t4, to a winding shaft t6 in the head box t1 so as to be capable of being wound up in a helical manner around the winding shaft t6. Therefore, the weight bar t4 is supported by a plurality of lifting cords t5 wound around a lower part thereof.

The winding shaft t6 is supported so as to be capable of rotating by a bearing member t7 disposed in the head box t1, with other ends of the lifting cords t5 being attached thereto, and a driving shaft t8 of a hexagonal rod shape is inserted through a center of the winding shaft t6 so as not to be capable of rotating relative to each other.

An operation apparatus t9 is attached to an end of the head box t1, and a ball chain t11 is mounted on a pulley t10 supported in the operation apparatus t9 so as to be capable of rotating. When the ball chain t11 is operated to rotate the pulley t10 in a forward or rearward direction, the driving shaft t8 is rotated in a forward or rearward direction.

Figure 22:
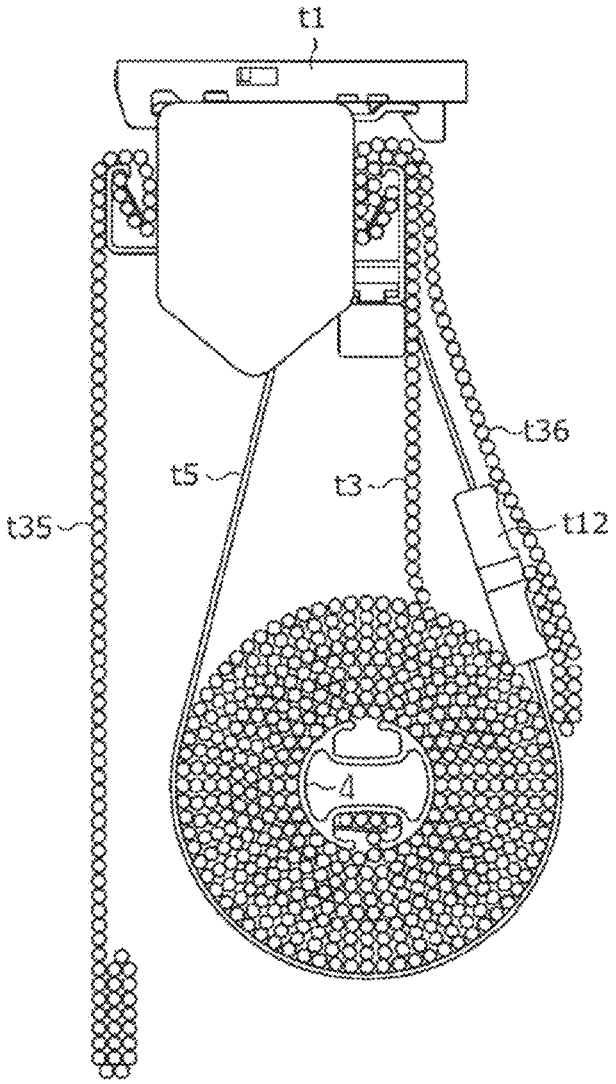
FIG. 22 is a side view of a screen in a raised state of the embodiment according to the third aspect of the present invention.

When the winding shaft t6 is rotated in a direction for winding up the lifting cords t5 based on a rotation of the driving shaft t8, one side of each of the lifting cords t5 supporting the weight bar t4 is raised, so that the weight bar t4 is raised while winding up the screen t3, and the screen t3 is wound up around the weight bar t4 as shown in FIG. 22.

Figure 23:
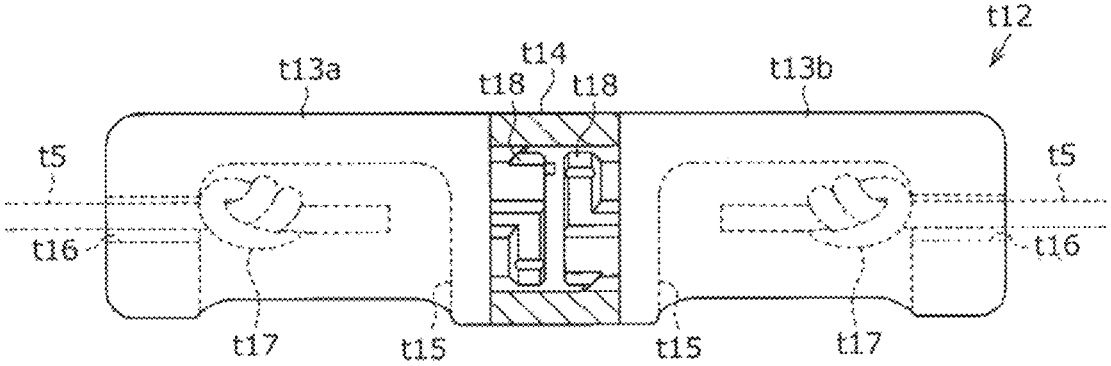
FIG. 23 is a front view of a cord joint of the embodiment according to the third aspect of the present invention.

A cord joint t12 is interposed within the lifting cord t5 in a vicinity of one end thereof. The cord joint t12 is composed, as shown in FIGS. 23 and 24, of a pair of joint main bodies t13*a*, t13*b* and a coupling member t14 configured to couple the joint main bodies t13*a*, t13*b*.

The joint main bodies t13*a*, t13*b* are formed each of a synthetic resin having elasticity into a generally columnar shape, and provided, at a central portion thereof, with a housing concave portion t15 which opens on one side of an outer peripheral surface. Further, the housing concave portion t15 communicates with one end of the joint main body t13*a*, t13*b* in a longitudinal direction by way of a communication hole t16.

Moreover, an end portion of the lifting cord t5 is inserted into the communication hole t16 from the one end of the joint main body t13*a*, t13*b* and lead to an inside of the housing concave portion t15, and then, a knot 17 is formed in the end portion, so that the joint main body t13*a*, t13*b* is attached to the end portion of the of the lifting cord t5.

Figure 24:
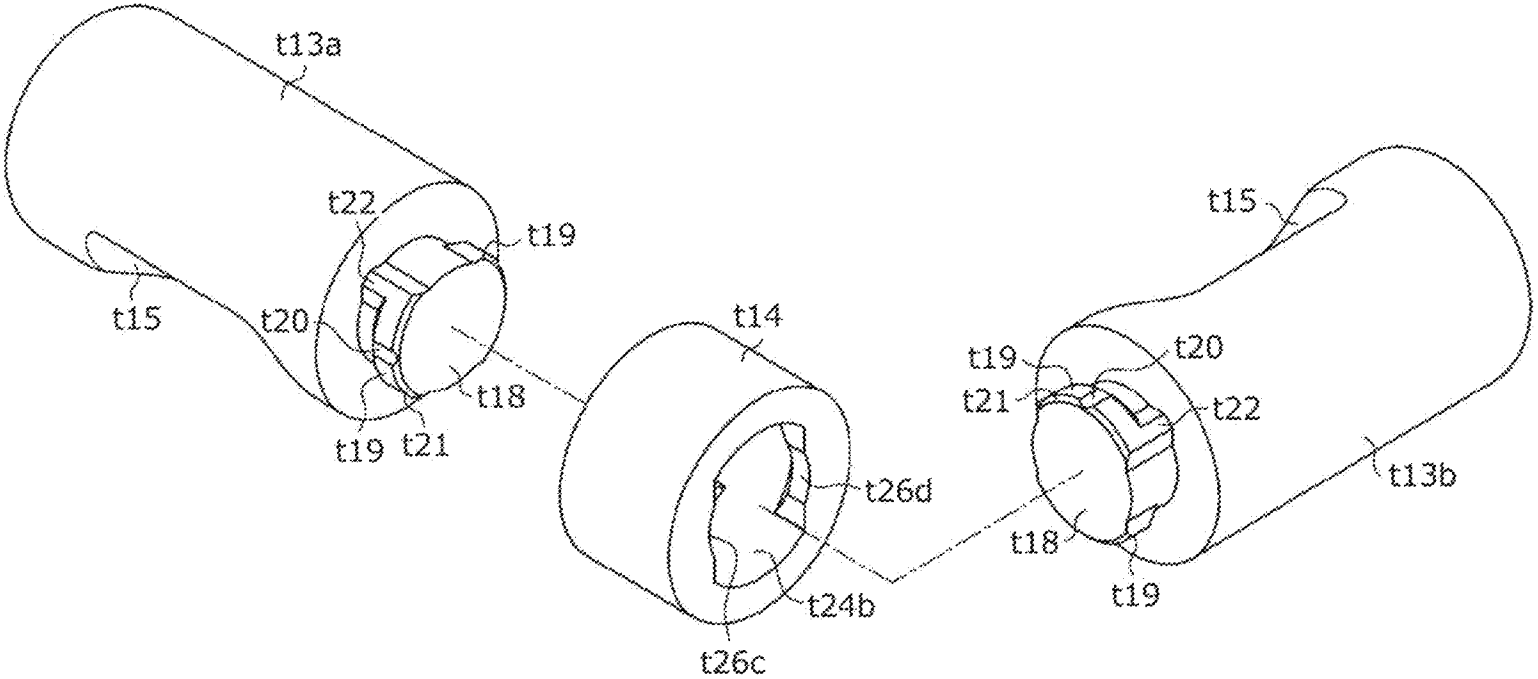
FIG. 24 is an exploded perspective view of the cord joint of the embodiment according to the third aspect of the present invention.
Figure 25:
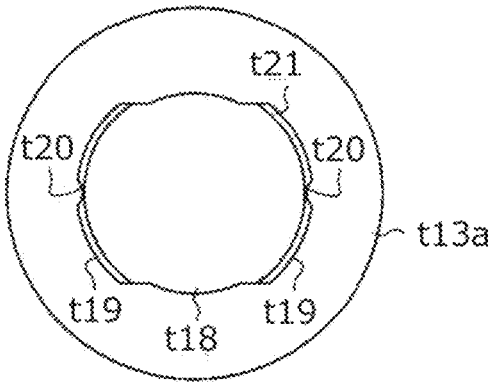
FIG. 25 is a side view of a joint main body of the embodiment according to the third aspect of the present invention.

A fitting convex portion t18 of a round rod shape is formed integrally on another end portion of each the joint main body t13*a*, t13*b*, as shown in FIGS. 24 and 25. Diametrically swelled portions t19 are formed on an outer peripheral surface of a front end portion of the fitting convex portion t18 line-symmetrically with respect to a center of the round rod, and a locking concave portion t20 with a semicircular cross-section is formed at a middle position of each of the diametrically swelled portions t19. Further, chamfered portions t21 are formed on a front end side and a base end side of the diametrically swelled portions t19.

Figure 26:
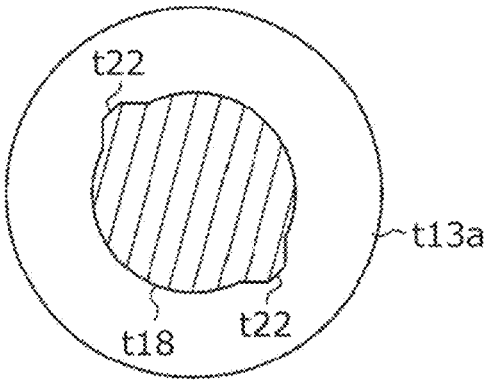
FIG. 26 is a sectional view of a base end portion of a fitting convex portion of the embodiment according to the third aspect of the present invention.

As shown in FIG. 26, rotation restricting portions t22 protruding in radial directions of the round rod are formed at a base end portion of the fitting convex portion t18 line-symmetrically with respect to a center. Further, each rotation restricting portion t22 is formed in a position apart by t45 degrees from the locking concave portion t20 in a circumferential direction with respect to a center of the round rod.

Figure 27:
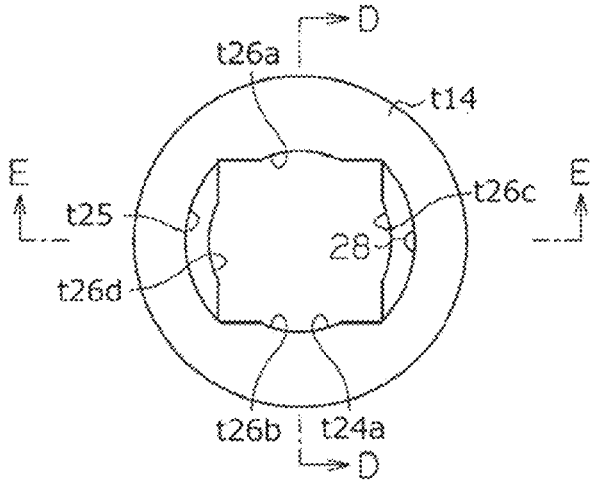
FIG. 27 is a front view of a coupling member of the embodiment according to the third aspect of the present invention.
Figure 28:
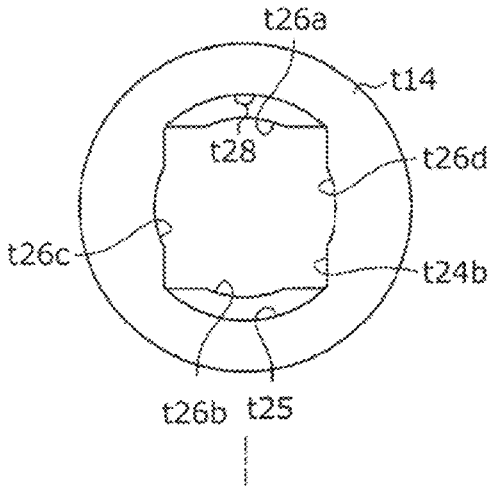
FIG. 28 is a rear view of the coupling member of the embodiment according to the third aspect of the present invention.

The coupling member t14 is formed of a same synthetic resin as that of the joint main bodies t13*a*, t13*b* into a tubular form, and, as shown in FIGS. 27 and 28, opening portions 24*a*, t24*b* on both sides are each formed into a log shape which allows a front end portion of the fitting convex portion t18 including the diametrically swelled portion t19 to be inserted therein. Further, the opening portions t24*a*, t24*b* are shaped such that directions of the log shapes are rotated by t90 degrees from each other with respect to the center of the tube.

Circular holes (fitting holes) t25 each having a diameter which enables a front end portion of the fitting convex portion t18 to rotate therein are formed inside the coupling member t14. Locking portions t26*a*, t26*b* configured to prevent the diametrically swelled portions t19 from coming off from the circular hole t25 are formed at both opening edges in a direction of a shorter axis of the opening portion t24*a* of a log shape, and locking portions t26*c*, t26*d* configured to prevent the diametrically swelled portions t19 from coming off from the circular hole t25 are formed at both opening edges in a direction of a shorter axis of the opening portion t24*b* of a log shape.

Figure 29:
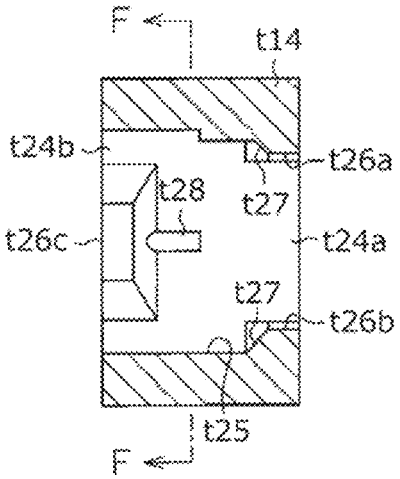
FIG. 29 is a sectional view taken along line D-D in FIG. 27 of the embodiment according to the third aspect of the present invention.
Figure 30:
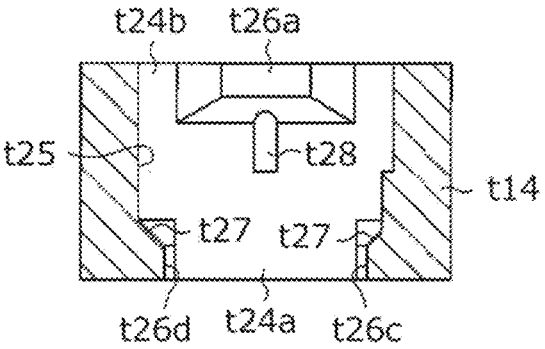
FIG. 30 is a sectional view taken along line E-E in FIG. 27 of the embodiment according to the third aspect of the present invention.
Figure 31:
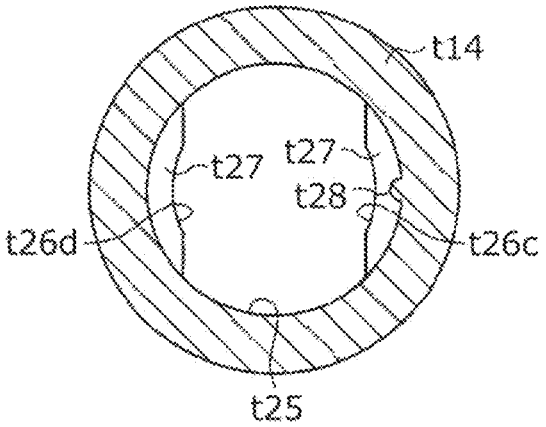
FIG. 31 is a sectional view taken along line F-F in FIG. 29 of the embodiment according to the third aspect of the present invention.

As shown in FIGS. 29 to 31, a chamfered portion t27 is provided at a boundary between the locking portion t26*a*-26*d* and the circular hole t25, so that when the fitting convex portion t18 is pulled out of the circular hole t25, the locking portion t26*a*-26*d* can be prevented from being damaged thanks to working of the chamfers portions t21, t27.

Figure 32:
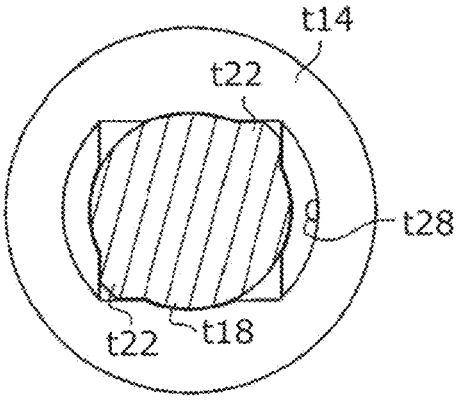
FIG. 32 is a sectional view showing a fitting state of the coupling member and a fitting convex portion of the embodiment according to the third aspect of the present invention.

Further, inside of the locking portion t26*a*, t26*c*, locking convex portions t28 configured to engage with the locking concave portions t20 are formed on inner peripheral surfaces of the circular holes t25. In order to couple the joint main bodies t13*a*, t13 together via the coupling member t14, the fitting convex portion t18 of the joint main body t13*a* is inserted into the opening portion t24*a* of the coupling member t14, and subsequently, the joint main body t13*a* is rotated toward the coupling member t14 by t90 degrees in a clockwise direction relative to the coupling member t14. As a result, the locking concave portion t20 of the fitting convex portion t18 is locked on the locking convex portion t28 within the circular hole t25, and the rotation restricting portion t22 is moved from a corner portion of the log shape of the opening portion t24*a* to an adjacent corner portion, so as to be positioned as shown in FIG. 32.

Also, the fitting convex portion t18 of the joint main body t13*b* is similarly inserted into the other opening portion t24*b* of the coupling member t14, and is rotated by t90 degrees so as to be positioned. As a result, as shown in FIG. 23, the joint main bodies t13*a*, t13*b* are coupled via the coupling member t14.

In this state, the diametrically swelled portions t19 of the fitting convex portion t18 of each of the joint main bodies t13*a*, t13*b* are engaged with the locking portions t26*a*-26*d* of the coupling member t14 so as to be held in the circular holes t25 of the coupling member t14. A holding force in this state is set such that the fitting convex portion t18 does not come off from the coupling member t14 with a usual pull force which is applied to the lifting cord t5 in a usual raising or lowering operation of the screen based on weights of the weight bar t4 and the screen t3, and, for example, a maximum value thereof is set at 85 N (Newton) and a minimum value is set at 40 N.

Only when a great force exceeding the usual pull force is applied to the lifting cord t5, the opening portions t24*a*, t24*b* of the coupling member t14 are expanded by the diametrically swelled portions t19 of the fitting convex portions t18 due to elasticity of the synthetic resin of the coupling member t14, so that the fitting convex portions t18 come off from the coupling member t14.

Further, when a holding force of the cord joint t12 of each lifting cord t5 is 85 N, and if, for example, a number of the lifting cords t5 is "n", a total holding force is (85×n). This total holding force is set so as to be greater than a half of the pull force based on the weights of the weight bar t4 and the screen t3. The number of the lifting cords is set at "2".

Figure 33:
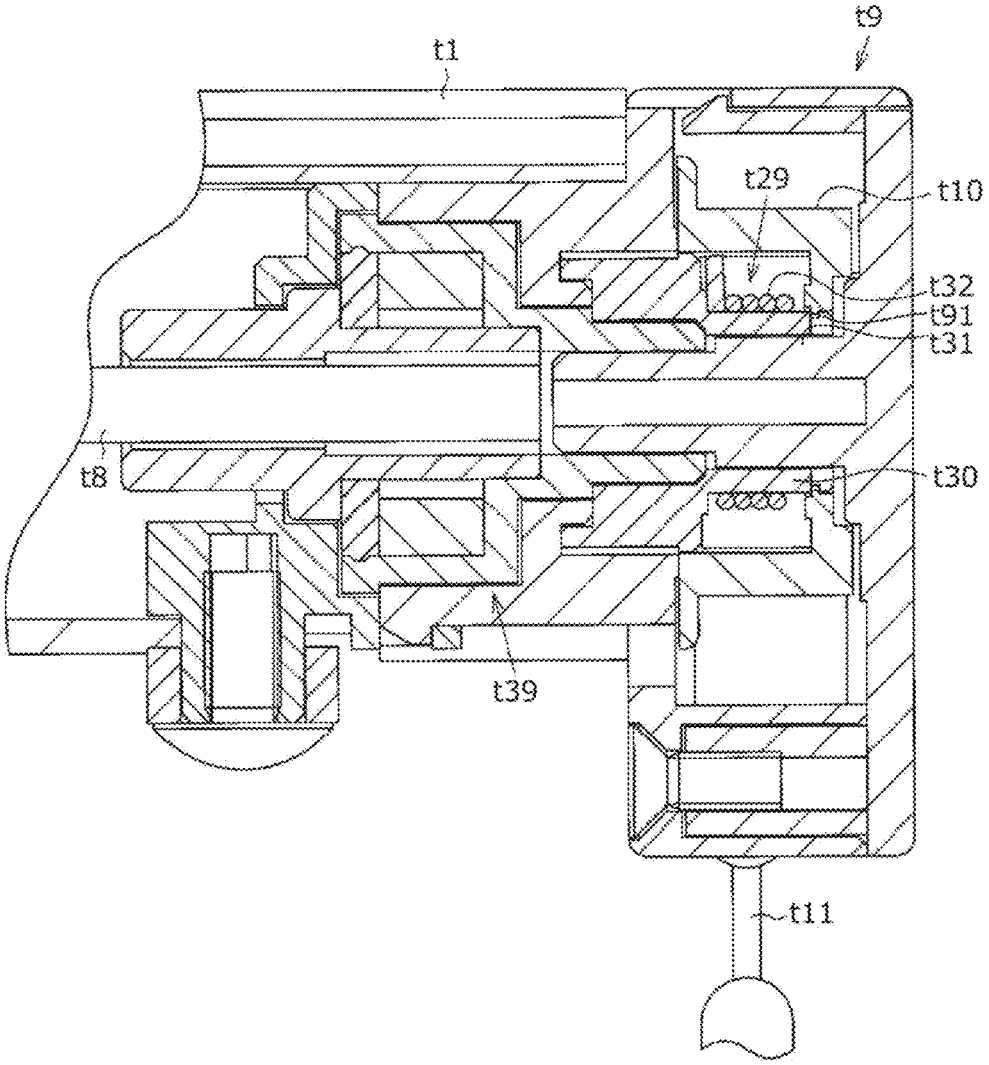
FIG. 33 is a sectional view of an operation apparatus of the embodiment according to the third aspect of the present invention.
Figure 34:
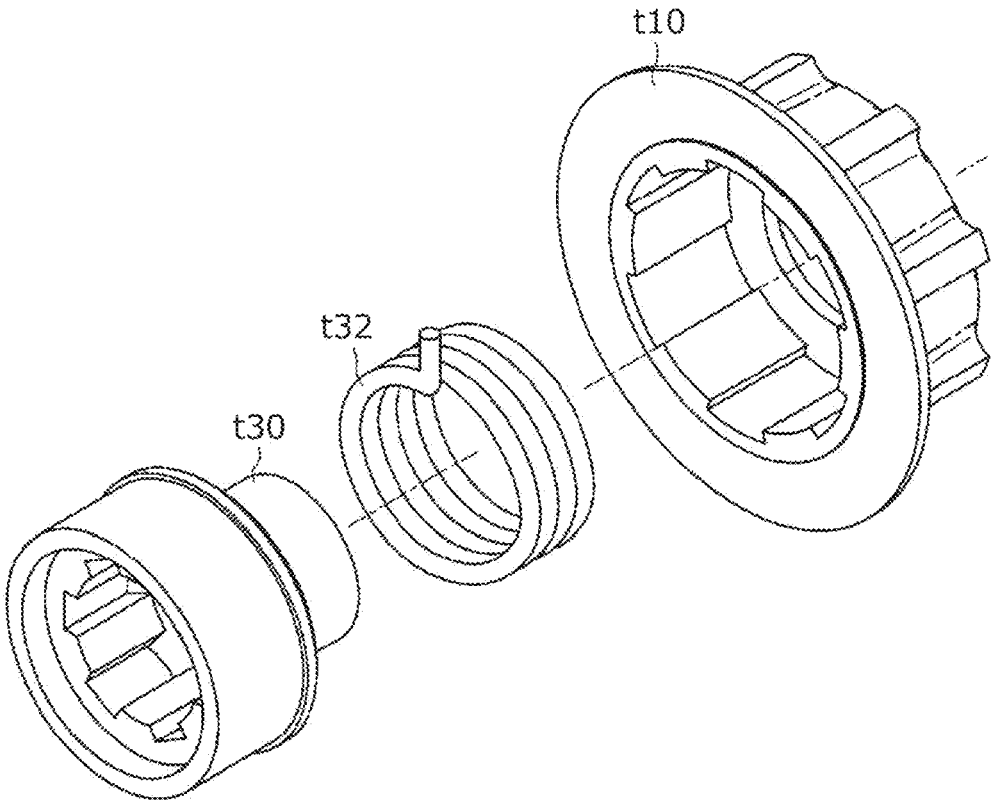
FIG. 34 is an exploded perspective view of a torque limiter of the embodiment according to the third aspect of the present invention.

In the operation apparatus t9, a rotation torque of the pulley t10 driven by an operation of the ball chain t11 is transmitted to the driving shaft t8 by way of the torque limiter t29. The torque limiter t29 is supported, as shown in FIGS. 33 and 34, by a transmission shaft t30 at the pulley t10 having a tubular shape so as to be capable of rotating, and the transmission shaft t30 is supported by a supporting shaft t31 provided on a case so as to be capable of rotating. A part of the transmission shaft t30 on a side of the pulley t10 is formed into a tubular shape, and a snap portion t91 is formed at a front end of a peripheral surface thereof. The snap portion t91 is engaged with a convex portion formed in a flange of the pulley t10, so that the transmission shaft t30 is supported so as to be capable of rotating relative to the pulley t10.

Further, a diameter of a part of the pulley t10 where the ball chain t11 is engaged (in this example, the radius is 10 mm) is set so as to be identical with that of a diameter of the winding shaft t6. A limit spring t32 composed of a helical torsion spring is disposed between the transmission shaft t30 and the pulley t10. The limit spring t32 is fitted on an outer peripheral surface of the transmission shaft t30, and one end thereof is engaged with an inner peripheral surface of the pulley t10 so as to be rotated integrally with the pulley t10.

Usually the pulley t10 and the transmission shaft t30 rotate integrally due to friction between the limit spring t32 and the transmission shaft t30 and the driving shaft t8 is rotated based on the transmission shaft t30.

Further, when the pulley t10 is rotated in a state in which a rotation of the driving shaft t8 is hindered, the limit spring t32 runs idle relative to the transmission shaft t30 so as not to transmit a rotation torque equal to or greater than a predetermined value to the driving shaft t8. A rotation torque with which the limit spring t32 starts to run idle relative to the transmission shaft t30 is set at 75 N·cm, in contrast to the fact that a total holding force of two lifting cords t5 is 170 N (corresponding to a torque of 170 N·cm for the driving shaft t8, a minimum value is 80 N·cm).

A one-way clutch t39 is disposed between the transmission shaft t30 and the driving shaft t8. The one-way clutch t39 is configured so as to transmit a rotation of the transmission shaft t30 in a direction for winding up the lifting cords to the driving shaft t8 but not to transmit a rotation in a direction for winding off the lifting cords to the driving shaft t8.

Figure 35:
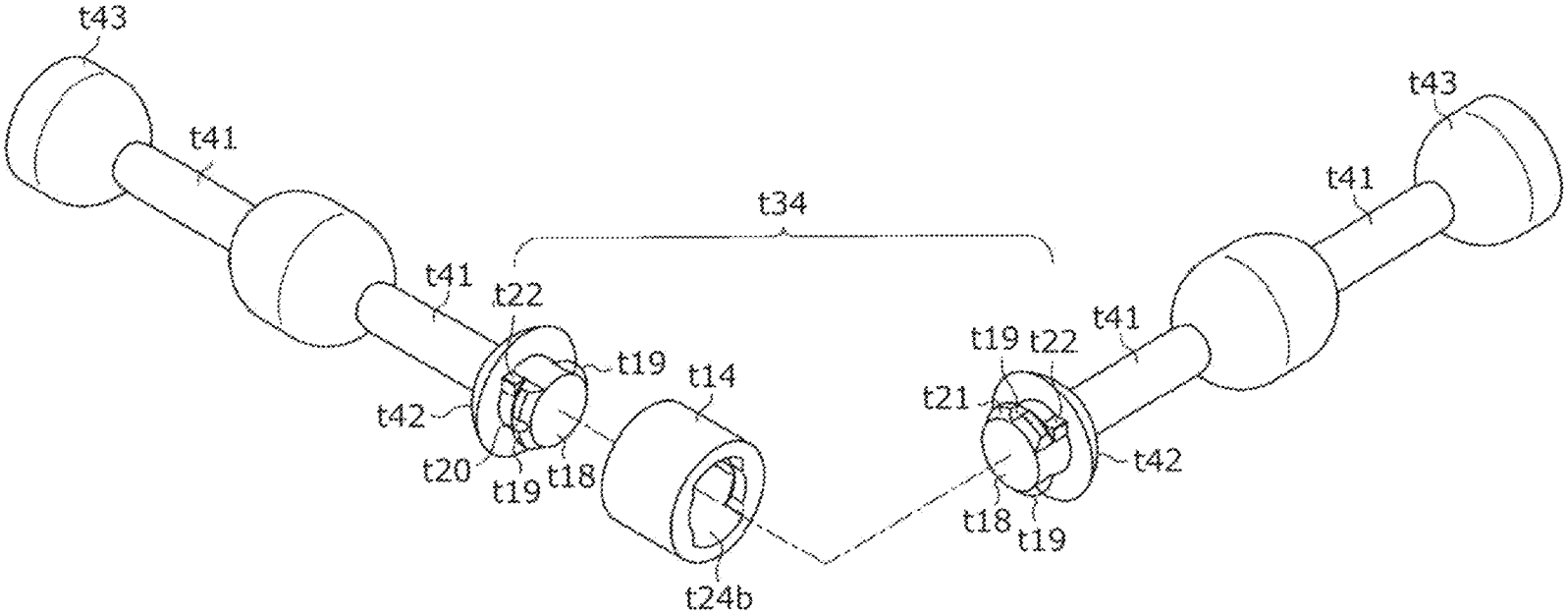
FIG. 35 is an exploded perspective view of a coupling section of a ball chain of the embodiment according to the third aspect of the present invention.

The ball chain t11 comprises a number of balls t33 formed on a cord at regular intervals through outsert molding, and is coupled by means of the coupling section t34 into an endless type. The coupling section t34 is configured, a shown in FIG. 35, such that a fitting portion t42 is formed through outsert molding on one end portion of a coupling cord t41, and a fitting convex portion t18 similar to the joint main body t13*a*, t13*b* is formed on the fitting portion t42.

Further, similarly to the cord joint t12, the coupling member t14 is so formed as to be divided with a pull force greater than a predetermined value by fitting the fitting convex portion t18 in the coupling member t14, and a force for dividing it is set, for example, at 95 N.

Note that a hemispherical portion t43 formed through outsert molding on another end portion of the coupling cord t41 is fused to a hemispherical portion molded on an end portion of the ball chain t11, so that the ball chain t11 of an endless type is formed. As shown in FIG. 22, a front balance t35 is attached to a front surface of the head box t1 in order to hide the head box t1 as well as the weight bar t4 raised to its upper limit. The balance t35 is composed of a chip-blind similar to that of the screen t3. A similar rear balance t36 is attached also to a rear surface of the head box t1.

In the head box t1 are disposed a known stopper apparatus t37 configured to hinder self-weight falling of the weight bar t4 and a governor apparatus t38 configured to restrict a rotation speed of the driving shaft t8 and thus to restrict a lowering speed of the weight bar t4 when an operation of the stopper apparatus t37 is canceled so as to allow the weight bar t4 to be lowered due to self-weight falling.

Now, behavior of the lifting apparatus of the roll-up blind configured as described above will be described. When the ball chain t11 is operated so as to rotate the winding shaft t6 in a direction for winding up the lifting cords t5 by way of the pulley t10, the torque limiter t29 and the driving shaft t8, the lifting cords t5 are wound up helically around the winding shaft t6.

Then, the weight bar t4 moves up while winding up the screen t3. When the weight bar t4 is raised to its upper limit, as shown in FIG. 22, the weight bar t4 having wound up the screen t3 is hidden behind the front balance t35 so as to be blocked out from the sight of the room interior.

When the ball chain t11 is released after raising the weight bar t4 to a desired level, the stopper operation t37 is activated, so that self-weight falling of the weight-bar t4 is hindered. In a state in which the weight bar t4 is suspended at the desired level, when the ball chain t11 is operated so as to rotate the driving shaft t8 slightly in the raising direction of the lifting cords, an operation of the stopper apparatus t37 is canceled, so that the winding shaft t6 is brought in a freely rotatable state. Thus, the weight bar t4 moves down in a state in which a lowering speed thereof is restricted by the governor apparatus t38 while winding off the screen t3.

If raising of the weight bar t4 is hindered by a certain obstacle while raising the screen 3, or when the weight bar t4 is raised to its upper limit, an operation force of the ball chain t11 is exerted on the lifting shafts t5 by way of the torque limiter t29, the driving shaft t8 and the winding shaft t6. When a torque of 75 N·cm is applied to the torque limiter t29, the limit spring t32 of the torque limiter t29 starts to run idle relative to the transmission shaft t30, so that the operation force being applied to the ball chain t11 is no more transmitted to the driving shaft t8.

Accordingly, even if raising of the weight bar t4 is hindered while raising the weight bar t4, or even if a further pull force is applied from the upper limit, a situation never arises where the cord joint t12 of the lifting cord t5 is divided. If a holding force of the cord joint t12 of each lifting cord t5 is 85 N, since a plurality of the lifting cords t5 are provided actually, the cord joint t12 is not divided unless a torque of (85×n) N·cm is applied to the winding shaft t6, assuming the number of the lifting cords is "n".

Meanwhile, if the lifting cord t5 is caught on a dweller moving in the room or another moving object, and as a result of it, a pull force of 85 N or greater is applied to the cord joint t12, fitting between at least either of the joint members t13*a*, t13*b* and the coupling member t14 is canceled, so that they are split.

Therefore, even if the lifting cord t5 is caught on a dweller moving in the room or another moving object, motion of the dweller or the object is not hindered. Further, if the ball chain t11 is caught on a dweller moving in the room or another moving object, so that a pull force of 95 N or greater is applied to the ball chain t11, the coupling section t34 comes off and the ball chain is split.

Accordingly, even if the ball chain t11 is caught on a dweller moving in the room or another moving object, motion of the dweller or the object is not hindered. With the lifting apparatus of the roll-up blind configured as described above, the following advantages can be obtained.

(1) In a case where the lifting cord t5 is caught on a dweller or the like, the joint main bodies t13*a*, t13*d* of the cord joint t12 are divided. Therefore, the lifting cord t5 can be equipped with a fail-safe function.

(2) Even if raising of the weight bar t4 is hindered during an operation of raising the screen t3, the torque limiter t29 starts to run idle prior to a division of the cord joint t12. Therefore, in an operation of raising the weight bar t4, falling of the weight bar t4 due to a division of the cord joint t12 can be prevented from occurring.

(3) After the cord joint t12 is split, the joint main bodies t13*a*, t13*b* can be coupled again with the coupling member t14, so that the cord joint t12 can be restored easily.

(4) In a case where the ball chain t11 is caught on a dweller or the like, the ball chain t11 is split at the coupling section t34. Therefore, the ball chain t11 can be equipped with a fail-safe function.

The embodiment described above may be carried out in the following manners.

The coupling section t34 of the ball chain t11 may be equipped with the function of the torque limiter t29. That is, the torque limiter t29 described above is omitted, and the holding force of the coupling section t34 is set smaller than the holding force of the cord joint t12 of the lifting cord t5. According to this configuration, in the operation of raising the weight bar t4, the coupling section t34 of the ball chain t11 is split prior to the division of the cord joint t12, so that, in the operation of raising the weight bar t4, falling of the weight bar t4 due to a division of the cord joint t12 can be prevented from occurring.

The embodiment of the third aspect may be carried out in the following manners as examples of values realizing child safety.

Radius of the winding shaft t6: 10 mm;

Radius of the pulley t10: 20 mm;

Minimum value of holding force of the cord joint t12: 10 N;

Number of the lifting cords t5 (number of the cord joints): t3 (minimum total holding torque applied to a plurality of the winding shafts t6: 30 N·cm);

Maximum rotation torque for activating the torque limiter: 20 N·cm;

Force for dividing the coupling section t34 of the ball chain t11: 15 N (maximum torque applied to the pulley from the chain: 30 N·cm).

Moreover, the embodiment of the third aspect may be carried out in the following manners as examples of values to be set in order to equip the ball chain with the function of the torque limiter t29 in a case where the torque limiter t29 is omitted.

Radius of the winding shaft t6: 10 mm;

Radius of the pulley t10: 10 mm;

Minimum value of holding force of the cord joint t12: 40 N;

Number of the lifting cords (number of the cord joints): t2 (minimum total holding torque applied to a plurality of the winding shafts t6: 80 N·cm).

The ball chain t11 may be substituted with an operation cord equipped with a fail-safe function.

The torque limiter may be formed of a disc spring, coil spring or rubber material having elasticity other than a limit spring.

Highly viscous Oil may be filled between the pulley and the transmission shaft in order to obtain a friction force.

DESCRIPTION OF REFERENCE NUMERALS (Reference Numerals in the Embodiments of the First Aspect of the Present Invention)

1 . . . head box; 2 . . . shielding member (upper screen); 4 . . . shielding member (lower screen); 11, 12 . . . driving shaft; 13 . . . operation apparatus; 15 . . . pulley; 16 . . . operation cord (ball chain); 17, 51 . . . transmission shaft (gear shaft); 18 . . . torque limiter (biasing means, limit spring); 32 . . . coupling section; 58 . . . torque limiter (biasing means, disc spring).

(Reference Numerals in the Embodiments of the Second Aspect of the Present Invention)

s1 . . . head box; s15 . . . operation unit; s17 . . . pulley; s18 . . . operation cord (ball chain); s19*a*, s19*b* . . . fixing apparatus; s20 . . . wall surface; s22, s24 . . . shaft; s27 . . . torque limiter (driving gear); s28 . . . torque limiter (cam member); s30*a*-s30*d* . . . torque absorbing means (concave/convex portion); s32 . . . torque limiter (torque absorbing means, biasing means, coil spring); s35 . . . coupling section; s41 . . . coupling cancellation means (fitting convex portion), s45 . . . coupling cancellation means (fitting hole).

(Reference Numerals in the Embodiment of the Third Aspect of the Present Invention)

t1 . . . head box; t3 . . . screen; t4 . . . weight bar; t5 . . . lifting cord; t6 . . . winding apparatus (winding shaft); t8 . . . driving shaft; t9 . . . operation apparatus; t10 . . . pulley; t11 . . . operation cord (ball chain); t12 . . . cord joint; t13*a*, t13*b* . . . joint main body; t14 . . . coupling member; t18 . . . fitting convex portion; t29 . . . transmission torque limiting apparatus (torque limiter); t34 . . . coupling section.

The invention claimed is:

1. An operation pulley capable of being assembled in an operation apparatus of a sunlight shielding apparatus, comprising:

a tubular pulley;

a ball chain configured to be mounted on the pulley; and a gear shaft or transmission shaft configured to engage with the pulley, wherein the ball chain is coupled via a coupling section into an endless type, the coupling section being configured to be decoupled with a first force which is a predetermined force, the pulley is provided, on an outer peripheral surface thereof, with a number of concavities configured to engage with balls of the ball chain, and, in an inward direction on an end surface of an input side, a flange formed integrally with the outer peripheral surface so as to be tubular toward an output side, and is engaged, at an opening on the output side, with the gear shaft or the transmission shaft so as to be capable of rotating relative to each other with friction, a slippage torque of a torque limiter provided between the pulley and the gear shaft or the transmission shaft is smaller than a first rotation torque exerted on the pulley with the first pull force, and the pulley is engaged with the gear shaft or the transmission shaft so that the pulley and the gear shaft or the transmission shaft rotate together when the torque applied to the pulley is below the slippage torque, and the pulley rotates relative to the gear shaft or the transmission shaft when the torque applied to the pulley is above the slippage torque.

2. The operation pulley of claim 1, wherein the gear shaft or the transmission shaft is provided with a tubular portion on a side of the pulley, the tubular portion being provided with a groove or a snap portion at a front end of a peripheral surface thereof, so that the gear shaft or the transmission shaft engages with the flange and is rotatably supported.

3. The operation pulley of claim 1, wherein the gear shaft obtains a friction force by being provided with a helical torsion spring in a tubular portion on the pulley side, and causes an end portion of the helical torsion spring to protrude in an outward direction so as to engage with an inner diameter of the pulley.

4. The operation pulley of claim 1, wherein a tubular cam member is provided so as to be capable of rotating and moving in an axial direction and a disc spring or a coil spring is disposed between the cam member and the pulley so as to bias them, whereby obtaining the friction force.

5. An operation apparatus of a sunlight shielding apparatus comprising the operation pulley of claim 1, wherein the pulley is supported so as to be capable of rotating in a head box, and a driving shaft is rotated based on an operation of the ball chain by way of the pulley so as to drive a shielding member.

6. The operation apparatus of a sunlight shielding apparatus of claim 5, wherein the sunlight shielding apparatus is configured such that the head box is provided, at both ends thereof, with fixing apparatuses having shafts protruding toward wall surfaces opposed to each other, the head box is fixed between the wall surfaces with a pushing force of the shafts, and the torque limiter limits a sum of a pull force exerted on the head box based on the operation of the ball chain and a weight of the sunlight shielding apparatus exerted on the head box to a range not exceeding a retention force due to the pushing force of the fixing apparatus.

7. A lifting apparatus of a roll-up blind, wherein the sunlight shielding apparatus is a roll-up blind in which a screen is suspended from the head box, a weight bar is suspended from a bottom of the screen, a lifting cord is wound around a lower part of the weight bar, an end of the lifting cord is fixed to the head box, and another end of the lifting cord is raised or lowered by a winding apparatus in the head box so as to wind up the screen around the weight bar or wind off the screen to raise or lower the screen, and the head box is provided with an operation apparatus configured to rotate a driving shaft of the winding apparatus by means of an operation of the ball chain, the operation apparatus is the operation apparatus of a sunlight shielding apparatus of claim 5.

* * * * *